US009146049B2

(12) United States Patent
Yamaguchi et al.

(10) Patent No.: US 9,146,049 B2
(45) Date of Patent: Sep. 29, 2015

(54) AUTOMATIC ICE MAKING MACHINE

(75) Inventors: Hiroki Yamaguchi, Toyoake (JP); Yuji Wakatsuki, Toyoake (JP)

(73) Assignee: HOSHIZAKI DENKI KABUSHIKI KAISHA, Aichi (JP)

( * ) Notice: Subject to any disclaimer, the term of this patent is extended or adjusted under 35 U.S.C. 154(b) by 940 days.

(21) Appl. No.: 13/201,207

(22) PCT Filed: Nov. 18, 2009

(86) PCT No.: PCT/JP2009/069575
§ 371 (c)(1),
(2), (4) Date: Aug. 11, 2011

(87) PCT Pub. No.: WO2010/109724
PCT Pub. Date: Sep. 30, 2010

(65) Prior Publication Data

US 2012/0000226 A1 Jan. 5, 2012

(30) Foreign Application Priority Data

Mar. 25, 2009 (JP) ..... 2009-074850

(51) Int. Cl.
*F25C 1/00* (2006.01)
*G05D 23/32* (2006.01)
*F25C 1/12* (2006.01)

(52) U.S. Cl.
CPC ..... *F25C 1/12* (2013.01); *F25C 2400/14* (2013.01); *F25C 2600/04* (2013.01); *F25C 2700/04* (2013.01); *F25C 2700/14* (2013.01); *F25D 2700/10* (2013.01)

(58) Field of Classification Search
CPC .... F25C 1/12; F25C 2400/14; F25C 2600/04; F25C 2700/04; F25C 2700/14; F25D 2700/10
USPC ..... 62/135, 157, 233, 347, 348, 349, 352, 62/353
See application file for complete search history.

(56) References Cited

U.S. PATENT DOCUMENTS 5,142,879 A * 9/1992 Nakamura et al. ..... 62/160
5,630,325 A * 5/1997 Bahel et al. ..... 62/222

(Continued)

FOREIGN PATENT DOCUMENTS

JP H06-74626 A 3/1899
JP S54-175070 A 12/1979

(Continued)

*Primary Examiner* — M. Alexandra Elve
*Assistant Examiner* — Henry Crenshaw
(74) *Attorney, Agent, or Firm* — DLA Piper LLP (US)

(57) ABSTRACT

An automatic ice making machine is provided that is capable of modifying an amount of feeding water depending on a temperature of makeup water. The automatic ice making machine is equipped with a deicing timer 42 to keep time of a deicing completion time period $T_1$ in which deicing operation is completed. In addition, in a control means 24, a deicing water longest supply time period $U_1$ is preset, which is a longest time period to supply deicing water in deicing operation. In a case where the deicing water is low in temperature, so that the deicing progresses slowly and thus the deicing completion time period $T_1$ becomes equal to or greater than the deicing water longest supply time period $U_1$, the control means 24 carries out water feeding in a feeding amount of water at low temperature at the time of water feeding. In contrast, in a case where deicing water is high in temperature, so that the deicing is promoted and thus the deicing completion time period $T_1$ becomes shorter than the deicing water longest supply time period $U_1$, the control means 24 carries out water feeding in a feeding amount of water at high temperature, which is more than the feeding amount of water at low temperature, at the time of water feeding.

3 Claims, 16 Drawing Sheets

(56) References Cited

U.S. PATENT DOCUMENTS

| | | | | |
|---|---|---|---|---|
| 5,934,094 | A * | 8/1999 | Itoh et al. | 62/222 |
| 6,321,548 | B1 * | 11/2001 | Clarke et al. | 62/222 |
| 7,000,422 | B2 * | 2/2006 | Street et al. | 62/298 |
| 2003/0074910 | A1 * | 4/2003 | Moon et al. | 62/196.4 |
| 2005/0097920 | A1 * | 5/2005 | Ezaki et al. | 62/527 |
| 2005/0126218 | A1 * | 6/2005 | Sohn | 62/527 |
| 2005/0159847 | A1 * | 7/2005 | Shah et al. | 700/276 |
| 2006/0086104 | A1 * | 4/2006 | Chang et al. | 62/129 |
| 2007/0157636 | A1 * | 7/2007 | Billman et al. | 62/73 |
| 2007/0204635 | A1 * | 9/2007 | Tanaka et al. | 62/129 |
| 2008/0216490 | A1 * | 9/2008 | Wakatsuki et al. | 62/74 |
| 2009/0235678 | A1 * | 9/2009 | Taras et al. | 62/115 |
| 2009/0241566 | A1 * | 10/2009 | Bush et al. | 62/115 |
| 2011/0016897 | A1 * | 1/2011 | Akagi et al. | 62/161 |
| 2011/0083455 | A1 * | 4/2011 | Jung et al. | 62/115 |

FOREIGN PATENT DOCUMENTS

| | | | |
|---|---|---|---|
| JP | 2000-258009 | A | 9/2000 |
| JP | 2008-232602 | A | 10/2008 |

* cited by examiner

AUTOMATIC ICE MAKING MACHINE

TECHNICAL FIELD

The present invention relates to an automatic ice making machine designed in such a manner that, in ice making operation, a refrigerant is supplied to an evaporator and also ice making water is supplied from an ice making water tank to an ice making unit to produce ice in the ice making unit, and makeup water is additionally supplied from an external water source via a water feeding means to an ice making water tank having a reduced amount of ice making water storage.

BACKGROUND ART

As an automatic ice making machine automatically producing a large amount of ice blocks, a flow-down type automatic ice making machine is known, for example, in which a vertically installed ice making unit is provided with an evaporation tube that is led out of a refrigeration system, and ice making water is spray supplied to the ice making unit that is cooled by this evaporation tube to produce ice blocks, and in which, in deicing operation, ice blocks are separated from the ice making unit to fall down and release. This automatic ice making machine is equipped with an ice making water tank to store a required amount of ice making water and is configured to, in ice making operation, pump the ice making water in the ice making water tank with an ice making water pump to supply it to the ice making unit, and to collect ice making water failed to freeze into the ice making water tank and then send it again towards the ice making unit. As the ice making unit completes ice making to be shifted from ice making operation to deicing operation, deicing water is spray supplied to a back face of the ice making unit to promote melting a frozen face with ice blocks and also the deicing water is collected into the ice making water tank, and this is used as ice making water in ice making operation for the next time.

In general, by supplying water at normal temperature from an external water supply source during deicing operation as deicing water (ice making water), such an automatic ice making machine described above is designed to be shifted to ice making operation after storing ice making water to be used for ice making operation for one cycle in the ice making water tank. That is, the ice making water tank needs a capacity capable of storing at least an amount of ice making water for one cycle of ice making operation (hereinafter, referred to as a necessary amount of ice making water), which has been a factor causing upsizing of the ice making water tank. In addition, in deicing operation, a lot of ice making water is necessary to be supplied to the ice making water tank, so that it takes time to fill the ice making water tank with ice making water, which also has caused a problem of longer deicing operation time period.

With that, an automatic ice making machine is proposed in which an ice making water tank having a capacity less than the necessary amount of ice making water is employed and, in a case where ice making water in the ice making water tank is lacking during ice making operation, water at normal temperature is additionally supplied from an external water source to the ice making water tank via a water feeding means as makeup water. Specifically, a float switch is equipped in the ice making water tank, and when the float switch detects a lower limit water level of ice making water during ice making operation, supply of makeup water is started by the water feeding means. Then, when the float switch detects an upper limit water level of ice making water, the water feeding means is designed to stop the supply of makeup water. This avoids upsizing of the ice making water tank to allow the entire size of the ice making machine to be compact and also to reduce the deicing time period (refer to Patent Document 1).

PRIOR ART DOCUMENT

Patent Document

Patent Document 1: Japanese Laid-Open Patent [Kokai] Publication No. Hei 6-74626.

SUMMARY OF THE INVENTION

Problem to be Solved by the Invention

As described above, in the automatic ice making machine shown in Patent Document 1, the amount of makeup water to be supplied by one cycle of water feeding is defined as a constant amount between the lower limit water level and the upper limit water level detected by the float switch. However, when the temperature of makeup water is high as in summer, for example, the temperature of ice making water in the ice making water tank rises due to the makeup water supplied to the ice making water tank, and when the ice making water with rising temperature is supplied to the ice making unit, ice blocks under production in the ice making unit are melted by the ice making water, and the melted water ends up being collected into the ice making water tank together with the ice making water. Accordingly, in addition to the makeup water from the water feeding means, the melted water is stored in the ice making water tank, so that the water level of the ice making water in the ice making water tank reaches the upper limit water level in a short period of time, and the amount of makeup water to be substantially supplied from the water feeding means for one cycle of water feeding becomes less. When such water feeding is carried out a plurality of times, the overall amount of fed water is lacking, which has been a cause of production of ice blocks smaller in size at the time of ice making completion.

In contrast, when the temperature of makeup water is low as in winter, for example, the temperature rise of the ice making water in the ice making water tank is suppressed and a slight amount of the ice blocks in the ice making unit is melted by the ice making water. Therefore, the water level of the ice making water in the ice making water tank rises slowly for the melted water collected less, and the amount of the makeup water to be substantially supplied from the water feeding means becomes more compared to a case of makeup water at high temperature. If such water feeding is carried out a plurality of times, then the overall amount of fed water becomes excessive, which can be a cause of production of huge ice blocks in the ice making unit at the time of ice making completion. Then, the production of huge ice blocks has sometimes caused deicing fault, or the huge ice blocks have sometimes caused deformation or damage in the ice making unit or the like.

With that, in view of the problems mentioned above inherent in an automatic ice making machine according to conventional techniques, the present invention is proposed to solve them suitably, and it is an object of the present invention to provide an automatic ice making machine that is designed to modify an amount of water feeding depending on a temperature of makeup water.

Means for Solving the Problem

In order to solve the above-mentioned problems and achieve the desired object, an automatic ice making machine according to the present invention, having an ice making unit to which ice making water is supplied while being cooled by an evaporator in ice making operation to produce ice and to which deicing water is supplied from an external water source while being heated by the evaporator in deicing operation to separate the ice, and an ice making water tank which is capable of storing ice making water to be supplied to the ice making unit in ice making operation and in which ice making water having flown down the ice making unit is collected, includes:

a deicing timer keeping time of a deicing completion time period required from the start of deicing operation until separation of ice produced in the ice making unit in ice making operation;

a control means having a preset deicing base elapsed time period and comparing/determining the deicing completion time period kept by the deicing timer and the deicing base elapsed time period; and a water feeding means being controlled, in ice making operation, to additionally supply makeup water in a feeding amount of water at low temperature from the external water source to the ice making water tank in which an amount of water storage is reduced by the control means having determined that the deicing completion time period kept by the deicing timer in deicing operation immediately before the ice making operation is equal to or greater than the deicing base elapsed time period, and being controlled to additionally supply the makeup water in a feeding amount of water at high temperature, which is more than the feeding amount of water at low temperature, to the ice making water tank in which the amount of water storage is reduced by the control means having determined that the deicing completion time period is shorter than the deicing base elapsed time period.

According to the present invention, in a case where a deicing completion time period is shorter than a preset deicing base elapsed time period due to high temperature of the deicing water, makeup water is supplied in a feeding amount of water at high temperature, which is more than a feeding amount of water at low temperature, at the time of water feeding in ice making operation for the next time, so that it is possible to prevent a decrease in ice making capacity due to lack in fed water and to produce ice in an appropriate size. When the deicing completion time period becomes equal to or greater than the deicing base elapsed time period due to deicing water at low temperature, makeup water is additionally supplied in the feeding amount of water at low temperature, which is less than the feeding amount of water at high temperature, at the time of water feeding in ice making operation for the next time, so that it is possible to prevent deicing abnormity and deformation, damage, or the like in the ice making unit due to excessive water feeding. Further, an amount of feeding water is modified based on the deicing completion time period that is varied depending on the temperature of deicing water from an external water source identical to that of the makeup water, so that water feeding can be carried out in the feeding amount of water precisely reflecting the temperature of makeup water and it is possible to securely prevent lack in water feeding and excessive water feeding.

In order to solve the problems mentioned above and to achieve the desired object, an automatic ice making machine according to another invention of the present application, having an ice making unit to which ice making water is supplied while being cooled by an evaporator in ice making operation to produce ice, and an ice making water tank which is capable of storing ice making water to be supplied to the ice making unit in ice making operation, in which ice making water having flown down the ice making unit is collected, and to which ice making water is supplied from an external water source before ice making operation is started, includes:

an ice making timer keeping time of a reference temperature reaching time period required from the start of ice making operation until a temperature on an exit side of the ice making unit in the evaporator is cooled to a preset reference temperature;

a control means having a preset ice making base elapsed time period required from the start of ice making operation in a state where ice making water at a predetermined base temperature is stored in the ice making water tank until the temperature on the exit side of the ice making unit in the evaporator is cooled to the reference temperature, and comparing/determining the reference temperature reaching time period kept by the ice making timer and the ice making base elapsed time period; and a water feeding means being controlled, in ice making operation, to additionally supply makeup water in a feeding amount of water at low temperature from the external water source to the ice making water tank in which an amount of water storage is reduced by the control means having determined that the reference temperature reaching time period kept by the ice making timer in the ice making operation is equal to or less than the ice making base elapsed time period, and being controlled to additionally supply the makeup water in a feeding amount of water at high temperature, which is more than the feeding amount of water at low temperature, to the ice making water tank in which an amount of water storage is reduced by the control means having determined that the reference temperature reaching time period is longer than the ice making base elapsed time period.

According to this invention, in a case where a reference temperature reaching time period is longer than a preset ice making base elapsed time period due to makeup water at high temperature, makeup water is supplied in the feeding amount of water at high temperature, which is more than the feeding amount of water at low temperature, at the time of additional supply of makeup water in ice making operation, so that it is possible to prevent a decrease in ice making capacity due to lack in water feeding and to produce ice in an appropriate size. When the reference temperature reaching time period is equal to or less than the ice making base elapsed time period due to makeup water at low temperature, makeup water is additionally supplied in the feeding amount of water at low temperature, which is less compared to the case of high temperature, so that it is possible to prevent deicing abnormity and deformation, damage, or the like in the ice making unit due to excessive water feeding. Further, the amount of feeding water is modified based on the reference temperature reaching time period that is varied depending on the temperature of the ice making water from an external water source identical to that of the makeup water, so that water feeding can be carried out in the feeding amount of water precisely reflecting the temperature of makeup water and it is possible to securely prevent lack in water feeding and excessive water feeding.

Effect of the Invention

According to an automatic ice making machine of the present invention, the amount of feeding water is designed to be modified depending on the temperature of makeup water, so that it is possible to prevent a decrease in ice making capacity due to lack in an amount of feeding water and occurrence of deicing fault or the like due to an excessive amount of feeding water.

MODE FOR CARRYING OUT THE INVENTION

Next, a description is given below to an automatic ice making machine according to the present invention by way of preferred Embodiments with reference to the attached drawings.

EMBODIMENTS

Embodiment 1

Figure 1:
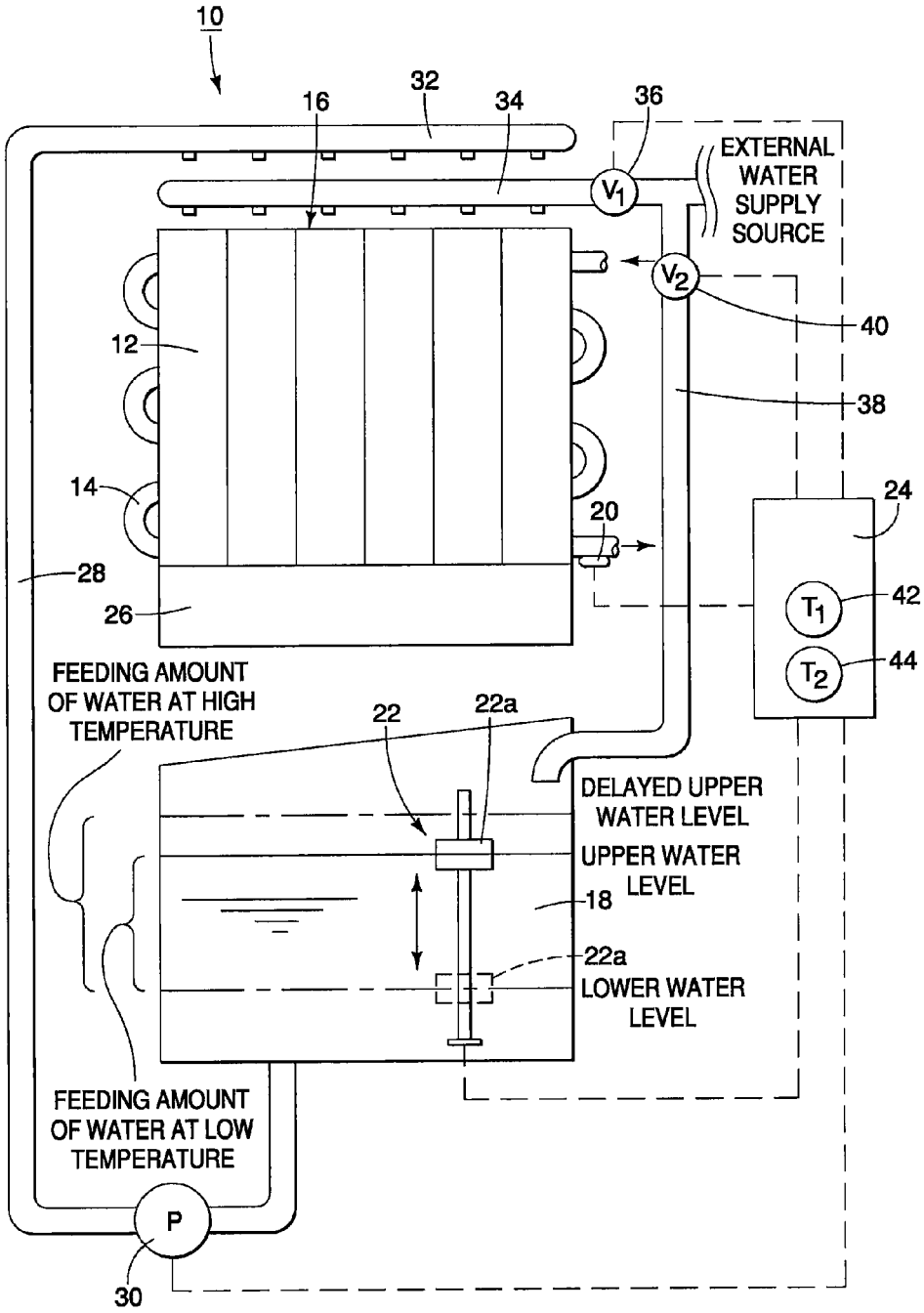
FIG. 1 is a schematic diagram illustrating the entire configuration of an automatic ice making machine according to Embodiment 1.

As illustrated in FIG. 1, an automatic ice making machine 10 according to this Embodiment is a so-called flow-down type automatic ice making machine and is equipped with an ice making unit 16 provided with an evaporation tube (evaporator) 14 led out of a refrigeration system (not shown) between a pair of ice making plates 12, 12 disposed facing each other (only one of them is shown in FIG. 1) and capable of production of ice blocks (ice), and an ice making water tank 18 provided below the ice making unit 16 and capable of storing ice making water. A refrigerant is designed to be supplied to the evaporation tube 14 from the refrigeration system in ice making operation to cool the ice making unit 16, and also a hot gas is designed to be supplied thereto from the refrigeration system in deicing operation to heat the ice making unit 16. The evaporation tube 14 is equipped with a temperature gauge 20 on an exit side of the ice making unit 16 to measure the temperature of the refrigerant heat exchanged with the ice making unit 16 by communicating through the evaporation tube 14 or the hot gas. The ice making water tank 18 is equipped with a float switch 22 and is designed to be capable of detecting the water level of ice making water in the ice making water tank 18 by allowing a float 22*a* of the float switch 22 to go up and down in accordance with the water level of ice making water.

Here, the capacity of the ice making water tank 18 is set to be less than the necessary amount of ice making water required to produce complete ice in the ice making unit 16 in ice making operation for one cycle (for example, set to be ½ to ⅓ of the necessary amount of ice making water). Accordingly, when the ice making water in the ice making water tank 18 is reduced to a predetermined amount in ice making operation, water at normal temperature is designed to be additionally supplied from an external water supply source (external water source) via a water feeding tube 38 described later as makeup water. The additional supply of makeup water carried out in ice making operation is performed a plurality of times (for example, two to three times). In the ice making water tank 18, a lower water level and an upper water level above the lower water level are set as water levels of ice making water, and when the water level of ice making water is at the lower water level or the upper water level, the float switch 22 is designed to send a detection signal thereof to a control means (described later) 24.

An ice guiding plate 26 is equipped between the ice making unit 16 and the ice making water tank 18 and is designed to guide ice blocks fallen down from the ice making unit 16 with the ice guiding plate 26 in deicing operation to release them to an ice storage, not shown. In this ice guiding plate 26, a plurality of return holes (not shown) are opened, and ice making water that has been supplied to the ice making unit 16 and has failed to freeze (unfrozen water) is designed to be collected into the ice making water tank 18 via the return holes. Deicing water that has been supplied to the ice making unit 16 in deicing operation is also collected into the ice making water tank 18 via the return holes to be used as ice making water in ice making operation for the next time.

An ice making water supply tube 28 is led out of a bottom portion of the ice making water tank 18, and in the middle of the supply tube 28, an ice making water pump 30 is equipped to pump ice making water in the ice making water tank 18 to the ice making unit 16. The ice making water supply tube 28 is connected to an ice making water spray (ice making water supply means) 32 that extends above the ice making unit 16, and ice making water is designed to be spray supplied to the ice making unit 16 via the ice making water spray 32.

Above the ice making unit 16, a deicing water spray (deicing water supply means) 34 is provided to supply deicing water between the ice making plates 12, 12. This deicing water spray 34 is connected to an external water supply source, and water at normal temperature is supplied between the ice making plates 12, 12 via the deicing water spray 34 as deicing water. The deicing water spray 34 is equipped with a deicing water valve 36, and by opening and closing the deicing water valve 36, the supply of deicing water from the deicing water spray 34 is designed to be controllable. The opening and closing control of this deicing water valve 36 is carried out by the control means 24.

The water feeding tube 38 is led out of the external water supply source identical to that of the deicing water spray 34, and an open end of the water feeding tube 38 is opened in the upper inside of the ice making water tank 18. When ice making water in the ice making water tank 18 is reduced to a predetermined water level in ice making operation, makeup water is configured to be supplied to the ice making water tank 18 via the water feeding tube 38. This water feeding tube 38 is equipped with a water feeding valve (water feeding means) 40, and by opening and closing the water feeding valve 40, water feeding to the ice making water tank 18 is controlled. The opening and closing control of this water feeding valve 40 is carried out by the control means 24.

The control means 24 is configured to control overall operation of the automatic ice making machine 10, and also to control the opening and closing of the water feeding valve 40 in a method of water feeding (hereinafter, referred to as a water feeding mode) determined based on the time period of completing deicing operation immediately before the ice making operation in ice making operation. The control means 24 is equipped with a deicing timer 42 to keep time of a deicing completion time period $T_1$ from the start of deicing operation to separation of ice produced in the ice making unit 16 and a delay timer 44 to keep time of a first delay time period that delays timing of stopping water feeding. In the control means 24, a deicing water longest supply time period $U_1$, which is a longest time period of deicing water supply to the ice making unit 16 in deicing operation is preset as a deicing base elapsed time period.

The deicing timer 42 is designed to be activated concurrently with start of deicing operation, and to be stopped when a measured temperature of the temperature gauge 20 (temperature of the hot gas) reaches a deicing completion temperature (for example, approximately 9° C.) to keep time of the deicing completion time period $T_1$. Here, when the deicing water supplied from the external water supply source is low in temperature, deicing progresses slowly and the deicing completion time period $T_1$ becomes long. In contrast, when the deicing water is high in temperature, deicing is promoted and the deicing completion time period $T_1$ becomes short. That is, the deicing completion time period $T_1$ is varied based on the temperature of deicing water, and thus by keeping time of the deicing completion time period $T_1$, the temperature of makeup water can be figured out indirectly that is supplied from the water source same as that of the deicing water. The deicing water longest supply time period $U_1$ is preset in the control means 24 to limit the amount of deicing water supply from the perspective of energy saving or the like. Accordingly, when the deicing water longest supply time period $U_1$ has elapsed in deicing operation, deicing water is not supplied in deicing operation thereafter to carry out deicing only with the hot gas.

Specifically, in a case where the temperature of deicing water is set at a predetermined base temperature and in a case where deicing operation is carried out using deicing water at the base temperature, the deicing water longest supply time period $U_1$ refers to the time period required to completely separate the ice blocks produced in the ice making unit 16. For example, in a case of the base temperature at 10° C., the deicing water longest supply time period $U_1$ is approximately six minutes. The control means 24 determines high-low of the temperature of deicing water relative to the base temperature by comparing/determining the deicing completion time period $T_1$ and the deicing water longest supply time period $U_1$, which enables to indirectly figure out the temperature of makeup water supplied from the external water supply source identical to that of the deicing water.

That is, in a case where the deicing completion time period $T_1$ is equal to or greater than the deicing water longest supply time period $U_1$ (in a case where the temperature of deicing water is lower than the base temperature), the control means 24 determines the amount of feeding water to be the feeding amount of water at low temperature and controls the water feeding valve 40 so as to carry out water feeding in the feeding amount of water at low temperature in ice making operation for the next time (hereinafter, referred to as a low temperature mode). In contrast, in a case where the deicing completion time period $T_1$ is shorter than the deicing water longest supply time period $U_1$ (in a case where the temperature of deicing water is higher than the base temperature), the control means 24 determines the amount of feeding water to be the feeding amount of water at high temperature, which is more than the feeding amount of water at low temperature, and controls the water feeding valve 40 so as to carry out water feeding in the feeding amount of water at high temperature in ice making operation for the next time (hereinafter, referred to as a high temperature mode). The base temperature of deicing water is set for each model of the automatic ice making machine 10, and the deicing water longest supply time period U1 is determined in accordance with the set value of the base temperature.

Figure 2:
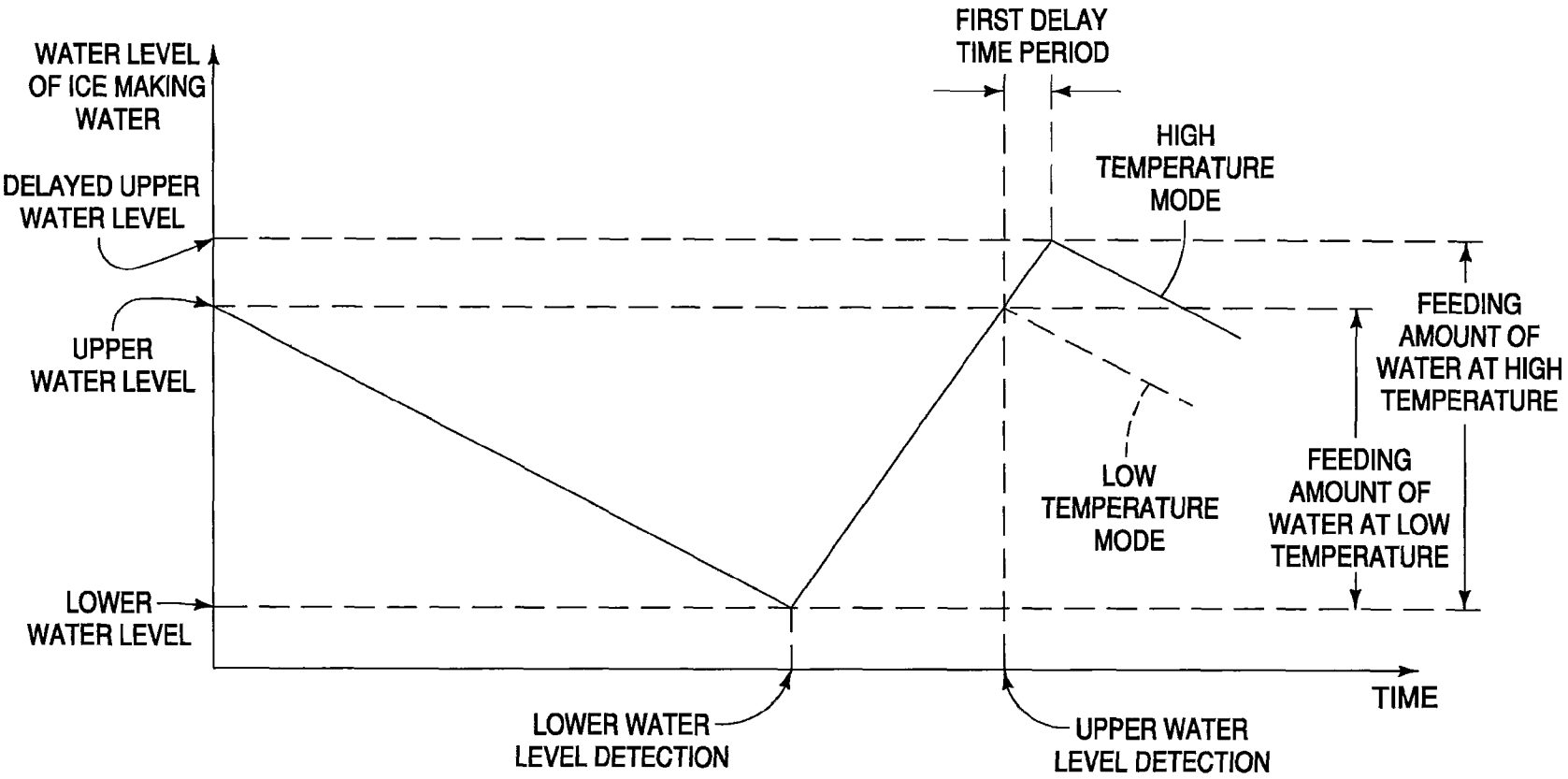
FIG. 2 is a graph showing variation in a water level of ice making water in an ice making water tank in Embodiment 1.

In the low temperature mode, the control means 24 is designed to open the water feeding valve 40 after the water level of ice making water in the ice making water tank 18 reaches the lower water level, and then to close the water feeding valve 40 when the water level of the ice making water reaches the upper water level. That is, the feeding amount of water at low temperature becomes the amount of feeding water by which the water level of ice making water in the ice making water tank 18 reaches the upper water level from the lower water level (refer to FIG. 2). In contrast, in the high temperature mode, the control means 24 opens the water feeding valve 40 after the water level of ice making water in the ice making water tank 18 reaches the lower water level, and then opens the water feeding valve 40 after the water level of the ice making water reaches the upper water level further until the first delay time period elapses. That is, suppose the water level of ice making water at the time when the first delay time period has elapsed is set as a delayed upper water level, the feeding amount of water at high temperature becomes the amount of feeding water by which the water level of ice making water reaches the delayed upper water level from the lower water level (refer to FIG. 2).

Operation of Embodiment 1

Next, a description is given below to operation of an automatic ice making machine 10 according to Embodiment 1. In Embodiment 1, the control means 24 determines the amount of feeding water in ice making operation based on the deicing completion time period $T_1$ in deicing operation, so that the control means 24 cannot determine the amount of feeding water in the first ice making operation without going through deicing operation. With that, in the first ice making operation, the control means 24 is supposed to be preset so that the amount of feeding water is, for example, the feeding amount of water at low temperature.

Figure 3:
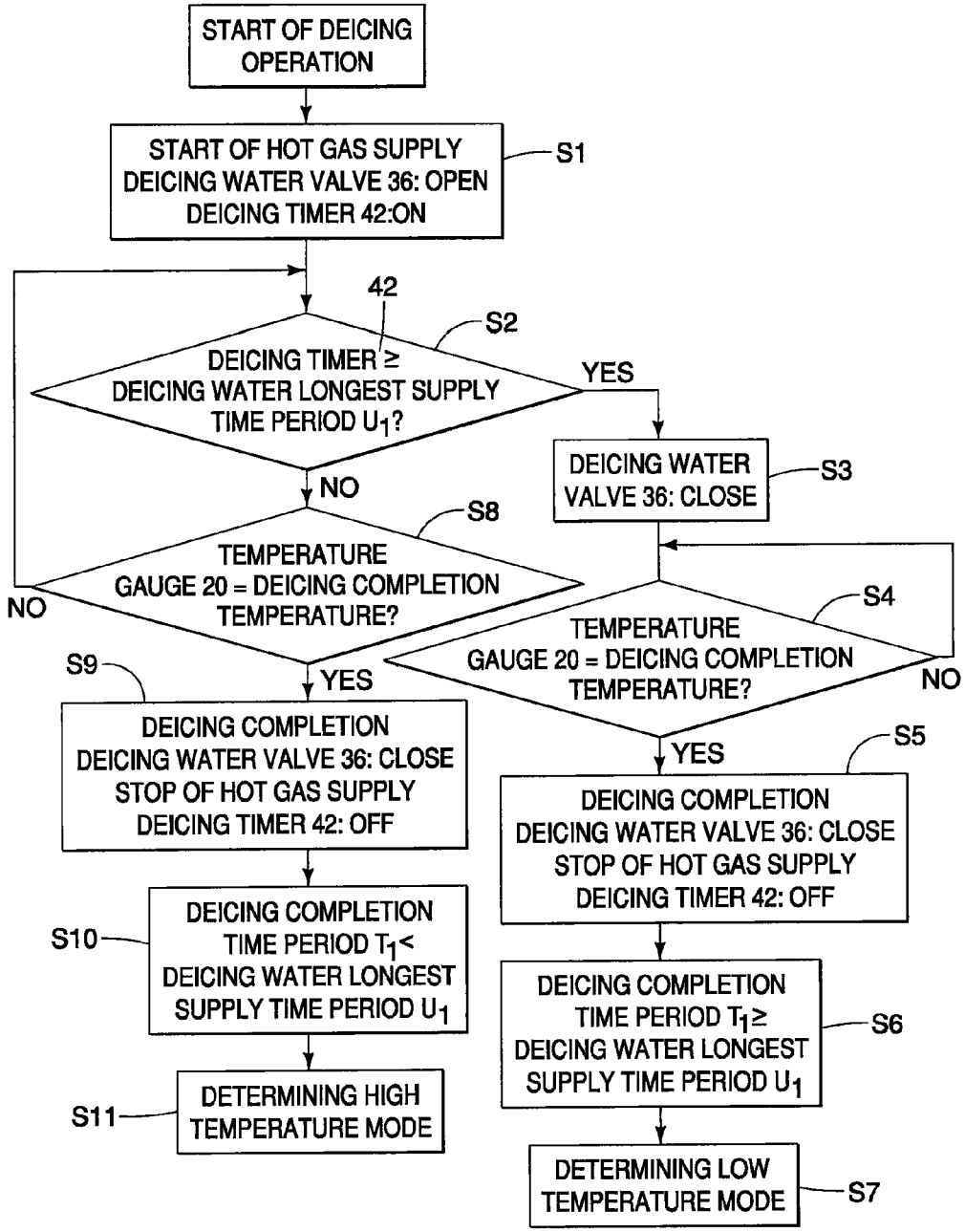
FIG. 3 is a flowchart showing a procedure of determining a water feeding mode in deicing operation of Embodiment 1.

When the first ice making operation is finished and deicing operation is started, as shown in FIG. 3, the control means 24 allows a hot gas to be supplied to the evaporation tube 14 and also the deicing water valve 36 to be opened, and thus the deicing water is supplied between the ice making plates 12, 12 from the external water supply source via the deicing water spray 34. In addition, the deicing timer 42 built in the control means 24 is activated to start keeping time of the deicing completion time period $T_1$ (Step S1). Then, the ice making unit 16 is heated by the hot gas and the deicing water to start melting ice blocks gradually on the ice making plate 12. Then, as the deicing operation progresses, the ice blocks are detached and fall down from the ice making plate 12 to be released to the ice storage via the ice guiding plate 26.

In contrast, the control means 24 determines whether or not the time measured by the deicing timer 42 is equal to or greater than the deicing water longest supply time period $U_1$ (Step S2). In a case where the time measured by the deicing timer 42 is equal to or greater than the deicing water longest supply time period $U_1$ (Yes in Step S2), the control means 24 closes the deicing water valve 36 to stop supply of deicing water (Step S3). That is, supply of deicing water more than that is stopped to suppress the amount of deicing water consumption and to suppress the running cost. Deicing operation thereafter is carried out only by heating the ice making unit 16 with the hot gas. Then, the control means 24 determines whether or not the temperature measured by the temperature gauge 20 reaches the deicing completion temperature (Step S4), and when the temperature measured by the temperature gauge 20 reaches the deicing completion temperature (Yes in Step S4), the control means 24 finishes the deicing operation and also stops the deicing timer 42 (Step S5). Then, the control means 24 compares the deicing completion time period $T_1$ and the deicing water longest supply time period $U_1$, resulting in the deicing completion time period $T_1$ being equal to or greater than the deicing water longest supply $U_1$ (Step S6), so that the water feeding mode is determined to be in the low temperature mode (Step S7). That is, since the temperature of deicing water (makeup water) is lower than the base temperature, the control means 24 determines to supply makeup water in the feeding amount of water at low temperature at the time of water feeding in ice making operation for the next time.

In contrast, in a case where the time measured by the deicing timer 42 does not elapse the deicing water longest supply time period $U_1$ in Step S2 (No in Step S2), the control means 24 determines whether or not the temperature measured by the temperature gauge 20 reaches the deicing completion temperature (Step S8). Then, when the temperature measured by the temperature gauge 20 reaches the deicing completion temperature (Yes in Step S8), the control means 24 finishes the deicing operation and also stops the deicing timer 42 (Step S9). Then, the control means 24 compares the deicing completion time period $T_1$ and the deicing water longest supply time period $U_1$, resulting in the deicing completion time period $T_1$ being shorter than the deicing water longest supply $U_1$ (Step S10), so that the water feeding mode is determined to be in the high temperature mode (Step S11). That is, since the temperature of deicing water (makeup water) is high, the control means 24 determines to supply makeup water in the feeding amount of water at high temperature at the time of water feeding in ice making operation for the next time.

Figure 4:
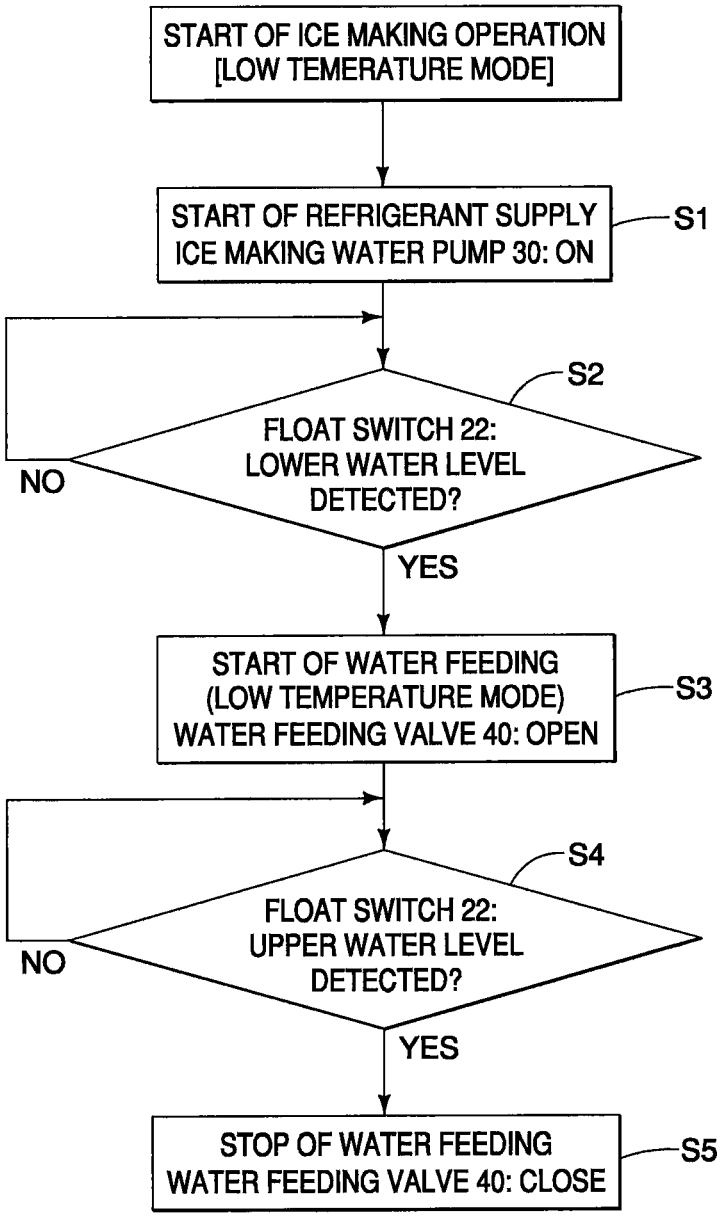
FIG. 4 is a flowchart showing a procedure of water feeding in a low temperature mode in ice making operation of Embodiment 1.

Next, an operation method in ice making operation is described. First of all, a description is given to an operation method in the low temperature mode, which is the case where the temperature of deicing water (makeup water) is lower than the base temperature, with reference to the flowchart in FIG. 4. When the ice making operation is started, the control means 24 allows a refrigerant to be supplied to the evaporation tube 14 and also activates the ice making water pump 30 to allow ice making water to be circulatively supplied to the ice making unit 16 (Step S1). Then, the refrigerant communicating through the evaporation tube 14 is heat exchanged with the ice making plate 12 to gradually cool the ice making plate 12 and thus ice blocks are started to be produced on a surface of the ice making plate 12. As the ice blocks on the ice making plate 12 grow, ice making water in the ice making water tank 18 is reduced and the water level of the ice making water becomes lower. Then, when the float switch 22 detects that the water level of ice making water has reached the lower water level (Yes in Step S2), the control means 24 opens the water feeding valve 40 to start additional supply of makeup water to the ice making water tank 18 (Step S3). The ice making water pump 30 is activated also at the time of water feeding and ice making water in the ice making water tank 18 continues to be supplied to the ice making unit 16, while the amount of feeding water from the water feeding tube 38 is set to be more than the amount of ice making water supply to the ice making unit 16, and thus the water level of ice making water in the ice making water tank 18 starts rising.

Then, when the water level of ice making water in the ice making water tank 18 reaches the upper water level (Yes in Step S4), the float switch 22 detects that to send a detection signal to the control means 24. Then, the control means 24 closes the water feeding valve 40 to stop supply of makeup water. That is, in the low temperature mode, makeup water is supplied in the feeding amount of water at low temperature from the lower water level to the upper water level of the ice making water tank 18 at the time of water feeding (refer to FIG. 2). In ice making operation thereafter, every time the ice making water in the ice making water tank 18 is at the lower water level, water feeding in the low temperature mode is repeated. Then, ice blocks in predetermined dimensions are produced on the ice making plate 12, and when the temperature measured by the temperature gauge 20 becomes the ice making completion temperature, the control means 24 finishes the ice making operation to shift it to deicing operation.

Figure 5:
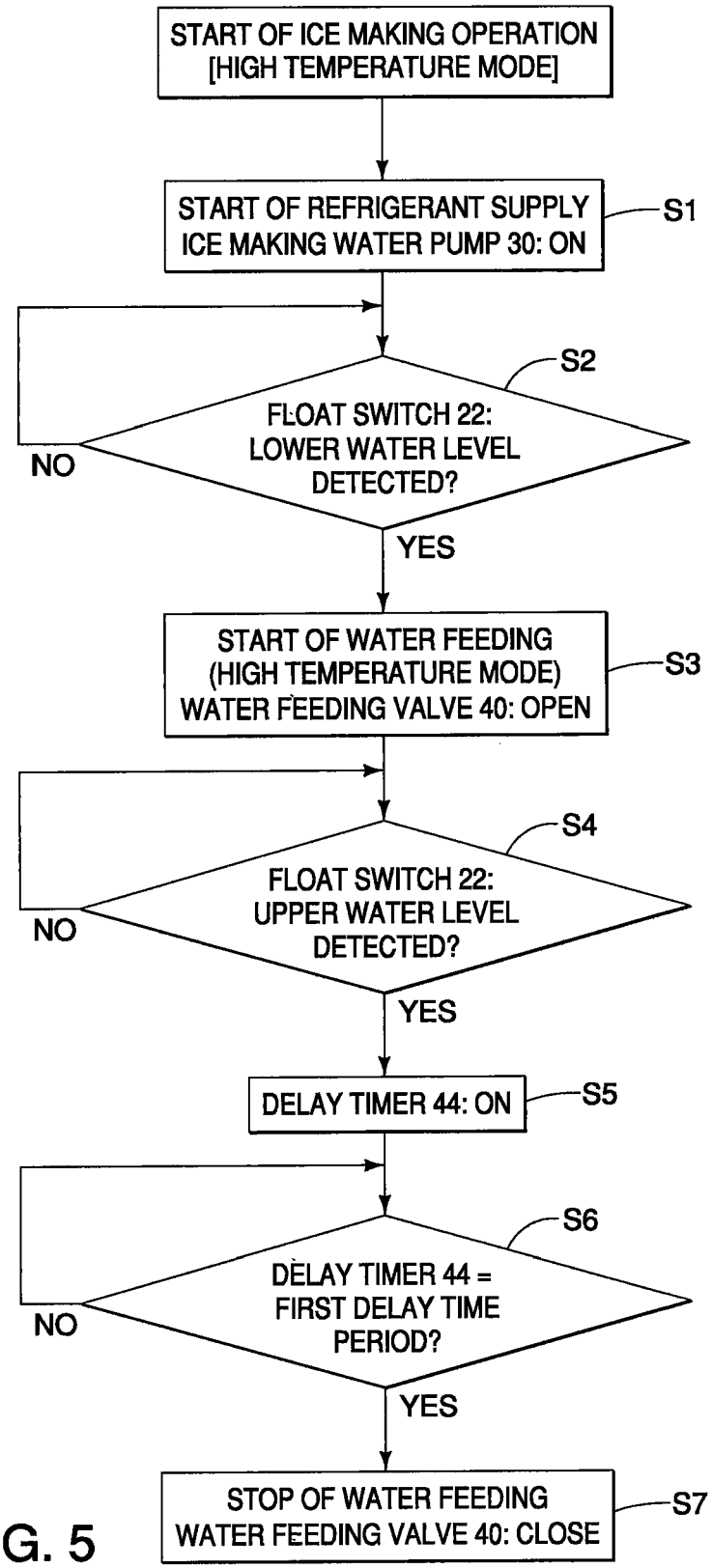
FIG. 5 is a flowchart showing a procedure of water feeding in a high temperature mode in ice making operation of Embodiment 1.

Next, a description is given to an operation method in the high temperature mode, which is the case where the temperature of deicing water (makeup water) is higher than the base temperature, with reference to the flowchart in FIG. 5. When ice making operation is started, in the same manner as in the low temperature mode, the control means 24 allows a refrigerant to be supplied to the evaporation tube 14 and also activates the ice making water pump 30 to allow ice making water to be circulatively supplied to the ice making unit 16 (Step S1). Then, when the float switch 22 detects that the water level of ice making water has been lowered to the lower water level (Yes in Step S2), the control means 24 opens the water feeding valve 40 to start supply of makeup water to the ice making water tank 18 (Step S3). Then, the water level of ice making water in the ice making water tank 18 starts rising.

When the water level of ice making water in the ice making water tank 18 reaches the upper water level (Yes in Step S4), the float switch 22 detects that and the control means 24 allows the delay timer 44 to be activated (Step S5). That is, even when the water level of ice making water in the ice making water tank 18 reaches the upper water level, water feeding is carried out without stopping. Then, when the delay timer 44 keeps time of the first delay time period (for example, three seconds) (Yes in Step S6), the control means 24 closes the water feeding valve 40 to stop water feeding. At this time, the water level of ice making water in the ice making water tank 18 has reached the delayed upper water level. That is, in the high temperature mode, makeup water is supplied in the feeding amount of water at high temperature by which it reaches the delayed upper water level from the lower water level (refer to FIG. 2). In ice making operation thereafter, every time ice making water in the ice making water tank 18 is at the lower water level, water feeding in the high temperature mode is repeated. Then, as the temperature measured by the temperature gauge 20 becomes the ice making completion temperature, the control means 24 finishes the ice making operation to shift it to deicing operation.

As thus described, according to the automatic ice making machine 10 of Embodiment 1, by allowing the timing of stopping water feeding to be delayed by the first delay time period in the high temperature mode, the water feeding time period is extended and it becomes possible to supply makeup water in the feeding amount of water at high temperature, which is more than the feeding amount of water at low temperature. Accordingly, a more amount of makeup water to be supplied to the ice making water tank 18 is secured to prevent lack in water feeding and thus ice blocks in an appropriate size can be produced at the time of ice making completion. In addition, in the low temperature mode, makeup water is supplied in the feeding amount of water at low temperature, which is less than the feeding amount of water at high temperature, so that it is possible to prevent production of huge ice blocks in the ice making unit 16 due to excessive water feeding. Accordingly, it is possible to suppress occurrence of deicing abnormity in which ice blocks cannot be deiced and deformation and damage in the ice making unit 16 due to huge ice blocks. Moreover, in Embodiment 1, the feeding amount of makeup water is determined based on the deicing completion time period $T_1$ varied depending on the temperature of deicing water (makeup water), so that water feeding can be carried out in an amount precisely reflecting the temperature of makeup water and thus it is possible to securely prevent lack in water feeding and excessive water feeding of makeup water.

In Embodiment 1, the water feeding mode is not determined in the first deicing operation, and in the first ice making operation, water feeding is carried out in the feeding amount of water at low temperature regardless of the temperature of makeup water. However, the control means 24 may also determine the water feeding mode from the first deicing operation. That is, as the first deicing operation is started, the control means 24 activates the deicing timer 42 to keep time of the deicing completion time period $T_1$. Then, by comparing the deicing completion time period $T_1$ and the deicing water longest supply time period $U_1$, the water feeding mode may also be determined. It should be noted that no ice block has been produced in the ice making unit 16 in the first deicing operation, so that the temperature gauge 20 immediately measures the deicing completion temperature. Therefore, the control means 24 determines that the deicing completion time period $T_1$ is shorter than the deicing water longest supply time period $U_1$, so that the water feeding mode always ends up being determined to be in the high temperature mode in the first deicing operation.

Modification of Embodiment 1

Next, an automatic ice making machine according to a modification of Embodiment 1 is described. In the modification of Embodiment 1, descriptions are given only to portions different from Embodiment 1, and descriptions to identical portions are omitted by assigning same reference numerals.

In the automatic ice making machine 10 according to Embodiment 1, the amount of feeding water in the high temperature mode is secured by delaying the timing of stopping water feeding during water feeding, while in the automatic ice making machine according to the modification of Embodiment 1, the amount of feeding water is designed to be secured in the high temperature mode by delaying the timing of starting water feeding during water feeding. That is, the delay timer 44 built in the control means 24 is designed to be activated when the water level of ice making water in the ice making water tank 18 reaches the lower water level in the high temperature mode to keep time of the second delay time period (for example, three seconds). Then, the control means 24 is set to open the water feeding valve 40 after the second delay time period has elapsed to start water feeding.

Figure 6:
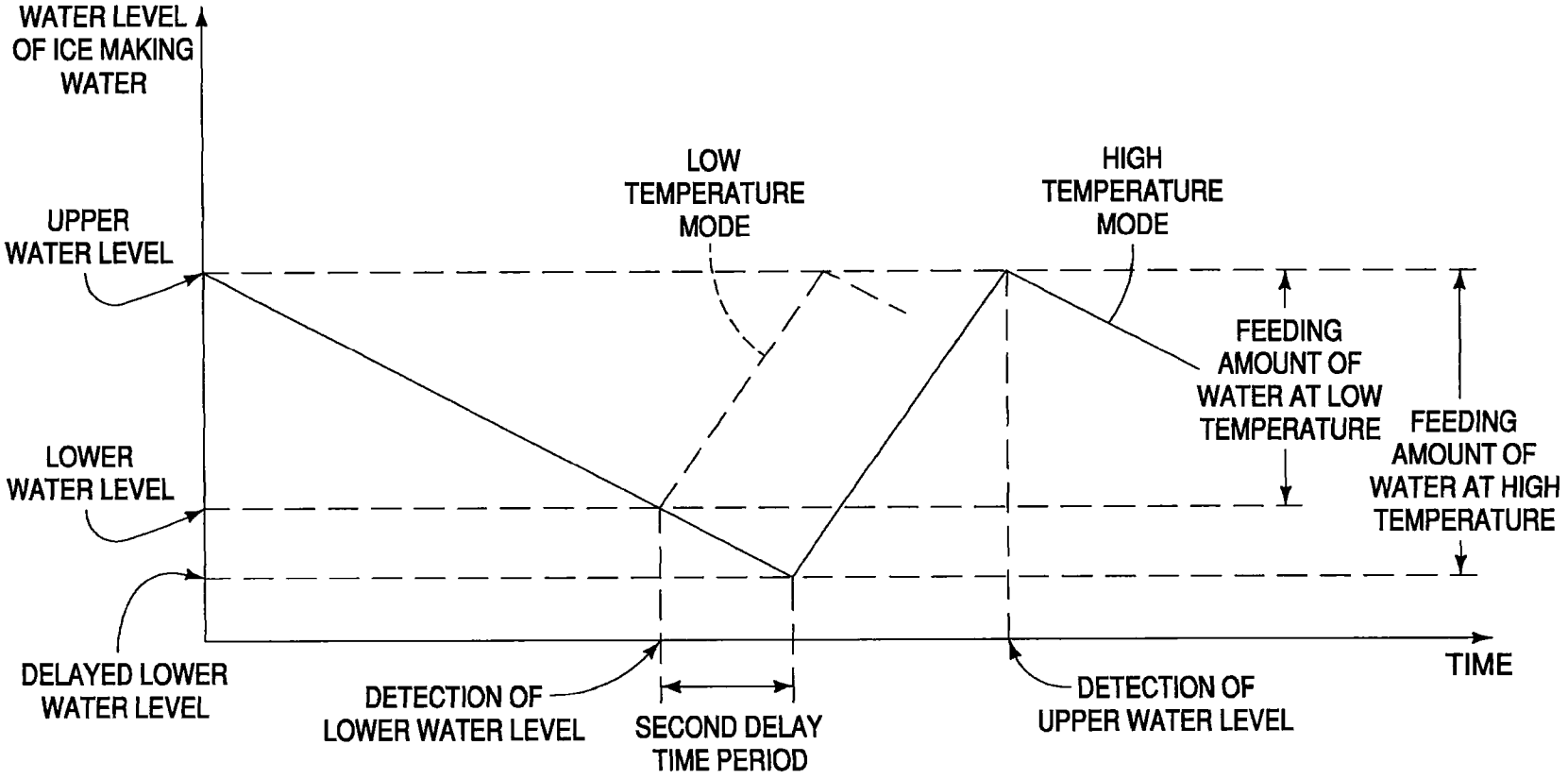
FIG. 6 is a graph showing variation in a water level of ice making water in an ice making water tank in a modification of Embodiment 1.

Here, ice making water in the ice making water tank 18 is supplied to the ice making unit 16 even while the second delay time period elapses, so that the water level of ice making water continues to be lowered. Accordingly, in the high temperature mode, as shown in FIG. 6, water feeding is started after ice making water reaches a water level below the lower water level (delayed lower water level). In addition, the control means 24 is set to stop water feeding when ice making water reaches the upper water level. That is, in the modification, the feeding amount of water at high temperature to be fed in the high temperature mode becomes the amount by which the water level of ice making water reaches the upper water level from the delayed lower water level. The feeding amount of water at low temperature to be fed in the low temperature mode is, in the same manner as Embodiment 1, set in the amount by which the water level of ice making water reaches the upper water level from the lower water level. In addition, the method of determining the water feeding mode in deicing operation is, in the same manner as Embodiment 1, designed to be determined by comparing the deicing completion time period $T_1$ and the deicing water longest supply time period $U_1$.

Figure 7:
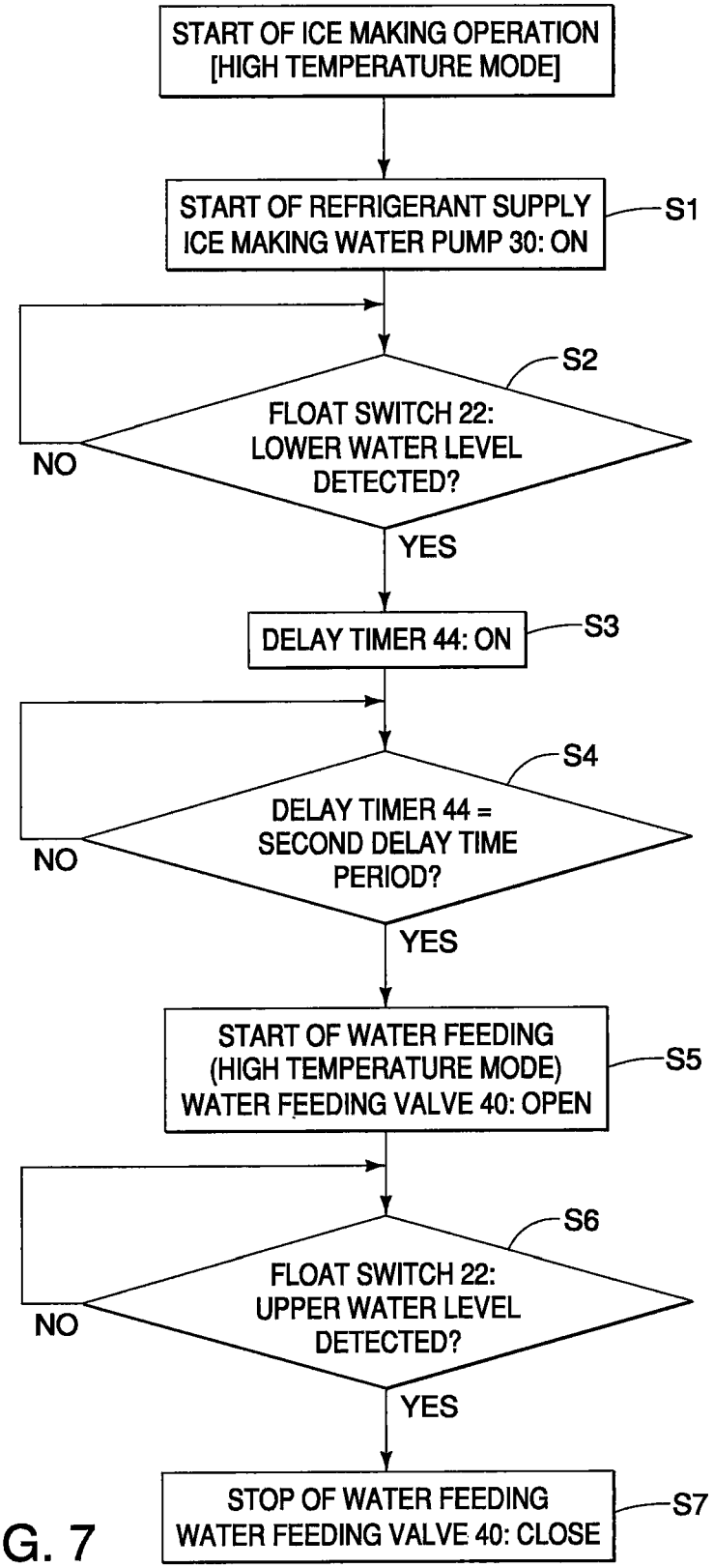
FIG. 7 is a flowchart showing a procedure of water feeding in a high temperature mode in ice making operation in a modification of Embodiment 1.

Next, a description is given to action of the automatic ice making machine according to the modification of Embodiment 1. The method of determining the water feeding mode is same as Embodiment 1 and thus is omitted (refer to the flowchart in FIG. 3). Firstly, to describe an operation method in the high temperature mode, as illustrated in FIG. 7, the control means 24 allows a refrigerant to be supplied to the evaporation tube 14 and also activates the ice making water pump 30 to supply ice making water to the ice making unit 16, thereby allowing ice making operation to be started (Step S1). When ice making water in the ice making water tank 18 is reduced and the float switch 22 detects the lower water level (Yes in Step S2), the control means 24 activates the delay timer 44 to keep time of the second delay time period (Step S3). Then, ice making water in the ice making water tank 18 is reduced until the second delay time period elapses, and the water level of ice making water continues to be lowered.

When the delay timer 44 keeps time of the second delay time period (Yes in Step S4), the control means 24 opens the water feeding valve 40 to start water feeding (Step S5). At this time, the water level of ice making water in the ice making water tank 18 has reached the delayed lower water level (refer to FIG. 6). By supplying makeup water to the ice making water tank 18, the water level of ice making water in the ice making water tank 18 starts rising, and when the float switch 22 detects that the water level of ice making water in the ice making water tank 18 has reached the upper water level (Yes in Step S6), the control means 24 closes the water feeding valve 40 to stop water feeding (Step S7).

As thus described, in the automatic ice making machine according to the modification of Embodiment 1, makeup water in the feeding amount of water at high temperature from the delayed lower water level to the upper water level is fed to the ice making water tank 18 in the high temperature mode, so that a more amount of feeding water can be secured in a case of makeup water at high temperature. Accordingly, it is possible to prevent lack in water feeding and to produce ice blocks in an appropriate size at the time of ice making completion. In ice making operation thereafter, every time the water level of ice making water reaches the lower water level, water feeding in the high temperature mode mentioned above is repeated. In addition, in a case where makeup water is low in temperature (low temperature mode), in the same manner as Embodiment 1, makeup water is supplied in the feeding amount of water at low temperature from the lower water level to the upper water level of the ice making water tank 18. Accordingly, deicing abnormity and deformation, damage, and the like of the ice making unit 16 due to excessive water feeding are suppressed.

In the modification of Embodiment 1, after detecting the lower water level, the start of water feeding is delayed by the second delay time period, reaching the upper water level, when the water feeding is stopped. However, it is also possible to combine the method of water feeding according to Embodiment 1 and the method of water feeding according to the modification. That is, the second delay time period has elapsed after the lower water level is detected, and then water feeding is started to reach the upper water level, and then further stopping of water feeding is delayed by the first delay time period. This may also allow makeup water to be supplied from the delayed lower water level to the delayed upper water level, so as to allow more makeup water to be supplied to the ice making water tank 18.

Embodiment 2

Next, an automatic ice making machine according to Embodiment 2 is described. In Embodiment 2, descriptions are given only to configurations different from those of Embodiment 1, and descriptions for the configurations identical to those of Embodiment 1 are omitted by assigning same reference numerals.

In the automatic ice making machine of Embodiment 2, the control means 24 is designed to determine the water feeding mode by comparing/determining the deicing completion time period $T_1$ and a minimum deicing time period (deicing base elapsed time period) $U_2$ in deicing operation. This minimum deicing time period $U_2$ is the time necessary to store deicing water to the upper water level in the ice making water tank 18 since deicing operation has started, and deicing operation is continued at least for the minimum deicing time period $U_2$. The minimum deicing time period $U_2$ is determined by the capacity of the ice making water tank 18 or the flow rate of deicing water supplied from the deicing water spray 34, and for example, the minimum deicing time period $U_2$ is set to be two minutes. Then, when the temperature of deicing water is low and the deicing progresses slowly so that the deicing completion time period $T_1$ is equal to or greater than the minimum deicing time period $U_2$, the control means 24 determines the water feeding mode to be in the low temperature mode.

In contrast, as the temperature of deicing water is high and the deicing is promoted so that the deicing completion time period $T_1$ is shorter than the minimum deicing time period $U_2$, the control means 24 determines the water feeding mode to be in the high temperature mode. As shown in Embodiment 1, the method of water feeding in the high temperature mode can employ a method of delaying the water feeding time period after detecting the upper water level (refer to FIG. 5), or, as in the modification of Embodiment 1, can employ a method of delaying water feeding start time after detecting the lower water level (refer to FIG. 7). In addition, the method of water feeding in the low temperature mode is same as that in Embodiment 1 (refer to FIG. 4).

Figure 8:
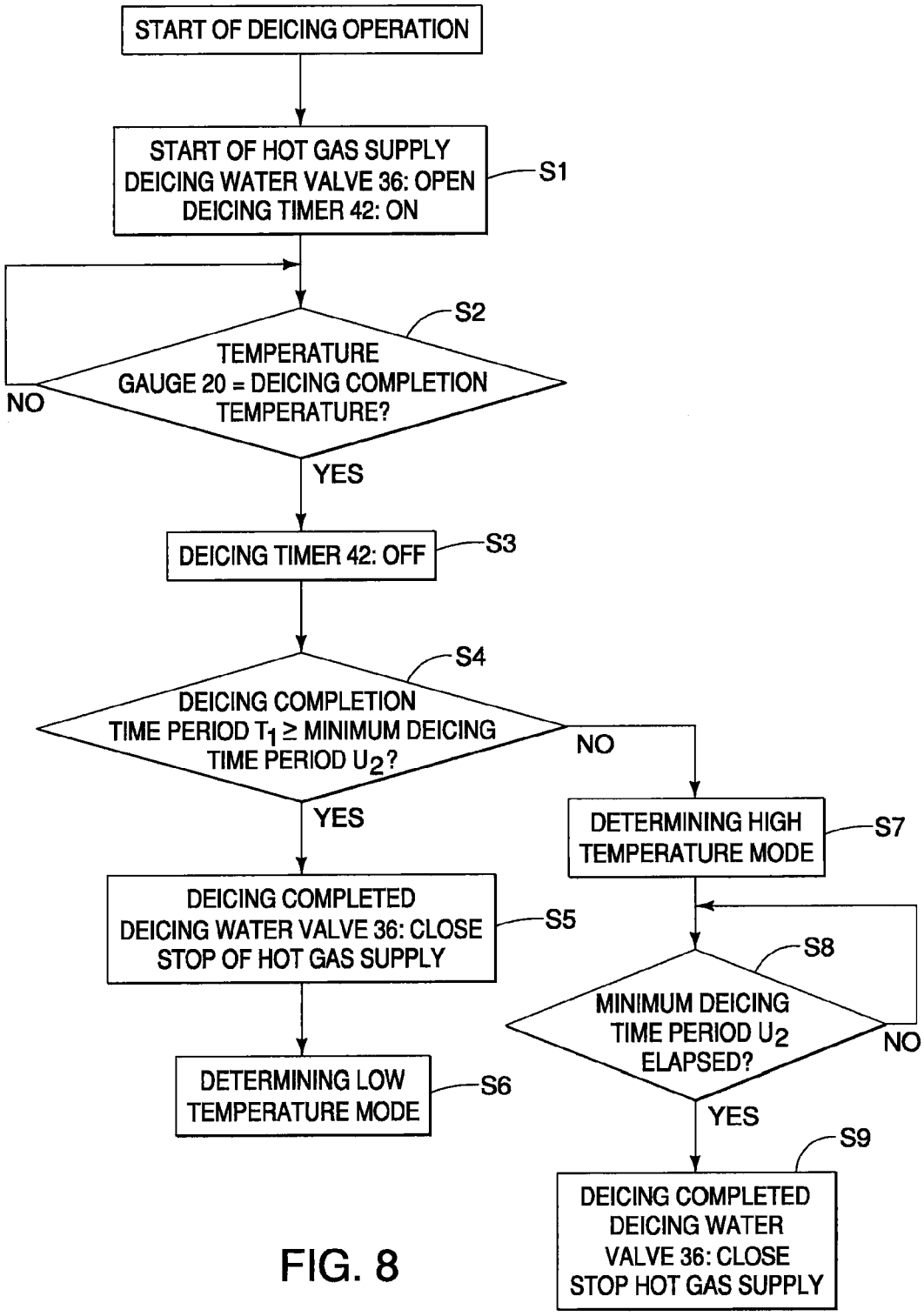
FIG. 8 is a flowchart showing a procedure of determining a water feeding mode in deicing operation of Embodiment 2.

Next, a description is given to operation of the automatic ice making machine of Embodiment 2 in a case of determining the water feeding mode. As shown in FIG. 8, when deicing operation is started, the control means 24 supplies a hot gas to the evaporation tube 14 and also opens the deicing water valve 36 to supply deicing water from the external water supply source via the deicing water spray 34 to the ice making unit 16 (Step S1). The control means 24 activates the deicing timer 42 to keep time of the deicing completion time period $T_1$. Next, the control means 24 determines whether or not the temperature measured by the temperature gauge 20 is the deicing completion temperature (Step S2). Then, if the temperature measured by the temperature gauge 20 is the deicing completion temperature (Yes in Step S2), the control means 24 stops the deicing timer 42 to measure the deicing completion time period $T_1$ (Step S3). Then, the control means 24 compares/determines the deicing completion time period $T_1$ and the minimum deicing time period $U_2$ (Step S4), and in a case where the deicing completion time period $T_1$ is equal to or greater than the minimum deicing time period $U_2$ (Yes in Step S4), it closes the deicing water valve 36 and also stops the supply of a hot gas to the evaporation tube 14 to finish deicing operation (Step S5). Then, since the deicing completion time period $T_1$ is equal to or greater than the minimum deicing time period $U_2$, the control means 24 determines the water feeding mode in ice making operation for the next time to be in the low temperature mode (Step S6).

In contrast, in a case where the deicing completion time period $T_1$ is shorter than the minimum deicing time period $U_2$ (No in Step S4), the control means 24 determines the water feeding mode to be in the high temperature mode (Step S7). Then, the control means 24 sustains deicing operation until the minimum deicing time period $U_2$ elapses (Step S8), and when the deicing time elapses the minimum deicing time period $U_2$ (Yes in Step S8), the control means 24 finishes the deicing operation (Step S9). As thus described, by carrying out deicing operation at least for the minimum deicing time period $U_2$, deicing water is stored to the upper water level in the ice making water tank 18 and is used as ice making water in ice making operation for the next time. As described above, in the automatic ice making machine according to Embodiment 2, the water feeding mode is determined on the basis of the minimum deicing time period $U_2$, so that an appropriate water feeding mode can be determined depending on the temperature of makeup water (deicing water). Moreover, the water feeding mode can be determined using the minimum deicing time period $U_2$ preset in the control means 24, so that it is not necessary to separately set the deicing base elapsed time period in the control means 24. As mentioned above, when the water feeding mode is determined, water feeding is carried out in a method same as that of Embodiment 1 or the modification of Embodiment 1 in ice making operation for the next time. That is, in the high temperature mode where makeup water is high in temperature, makeup water in the feeding amount of water at high temperature is supplied during water feeding, causing no decrease in the ice making capacity due to lack in water feeding. In addition, if makeup water is low in temperature, makeup water in the feeding amount of water at low temperature is fed and thus production of huge ice blocks due to excessive water feeding can be prevented.

Embodiment 3

Next, an automatic ice making machine according to Embodiment 3 is described below. Also in Embodiment 3, descriptions are given only to configurations different from Embodiment 1, and descriptions for the configurations same as Embodiment 1 are omitted by assigning same reference numerals.

Figure 9:
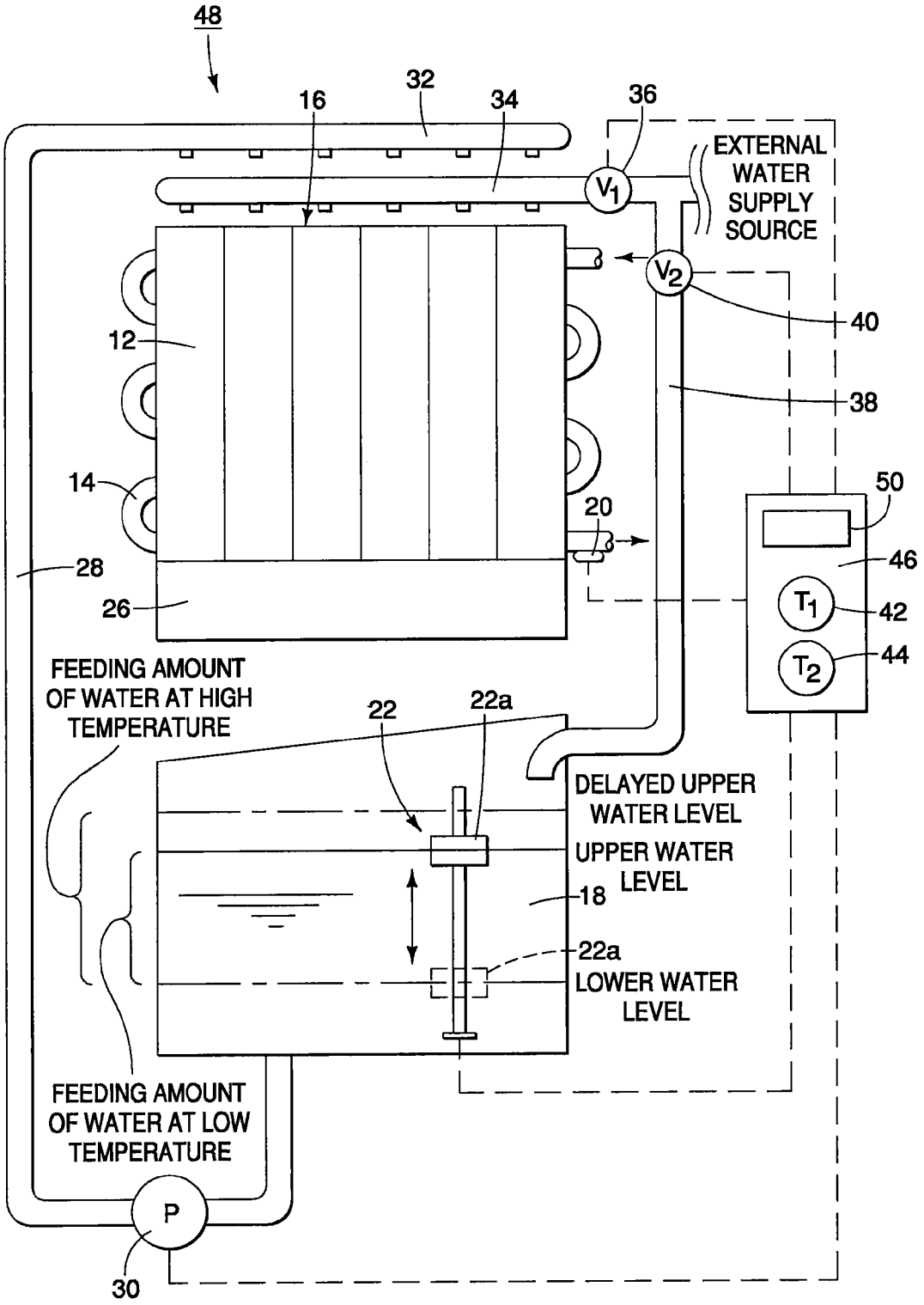
FIG. 9 is a schematic diagram illustrating the entire configuration of an automatic ice making machine according to Embodiment 3.

FIG. 9 is an illustrating drawing showing an automatic ice making machine 48 according to Embodiment 3. In Embodiment 3, a predetermined deicing base elapsed time period $U_3$ is preset in a control means 46, and when determining the water feeding mode, the control means 46 is designed to compare/determine the deicing completion time period $T_1$ and the deicing base elapsed time period $U_3$. This deicing base elapsed time period $U_3$ refers to time required to completely separate ice blocks in the ice making unit 16 in a case of deicing operation with deicing water at a predetermined base temperature. For example, when the base temperature of deicing water is set at 11° C., the deicing base elapsed time period $U_3$ is five minutes. Then, when the actual temperature of deicing water is lower than the base temperature, the deicing progresses slowly so that the deicing completion time period $T_1$ is equal to or greater than the deicing base elapsed time period $U_3$, and the control means 46 is designed to determine that makeup water is low in temperature in the same manner as deicing water to determine the water feeding mode to be in the low temperature mode. In contrast, in a case where the temperature of deicing water is higher than the base temperature, the deicing is promoted so that the deicing completion time period $T_1$ is shorter than the deicing base elapsed time period $U_3$, and the control means 46 is designed to determine that makeup water is high in temperature in the same manner as deicing water to determine the water feeding mode to be in the high temperature mode. The base temperature of deicing water is set for each model of the automatic ice making machine 48, and the deicing base elapsed time period U3 is determined in accordance with the set base temperature.

Figure 10:
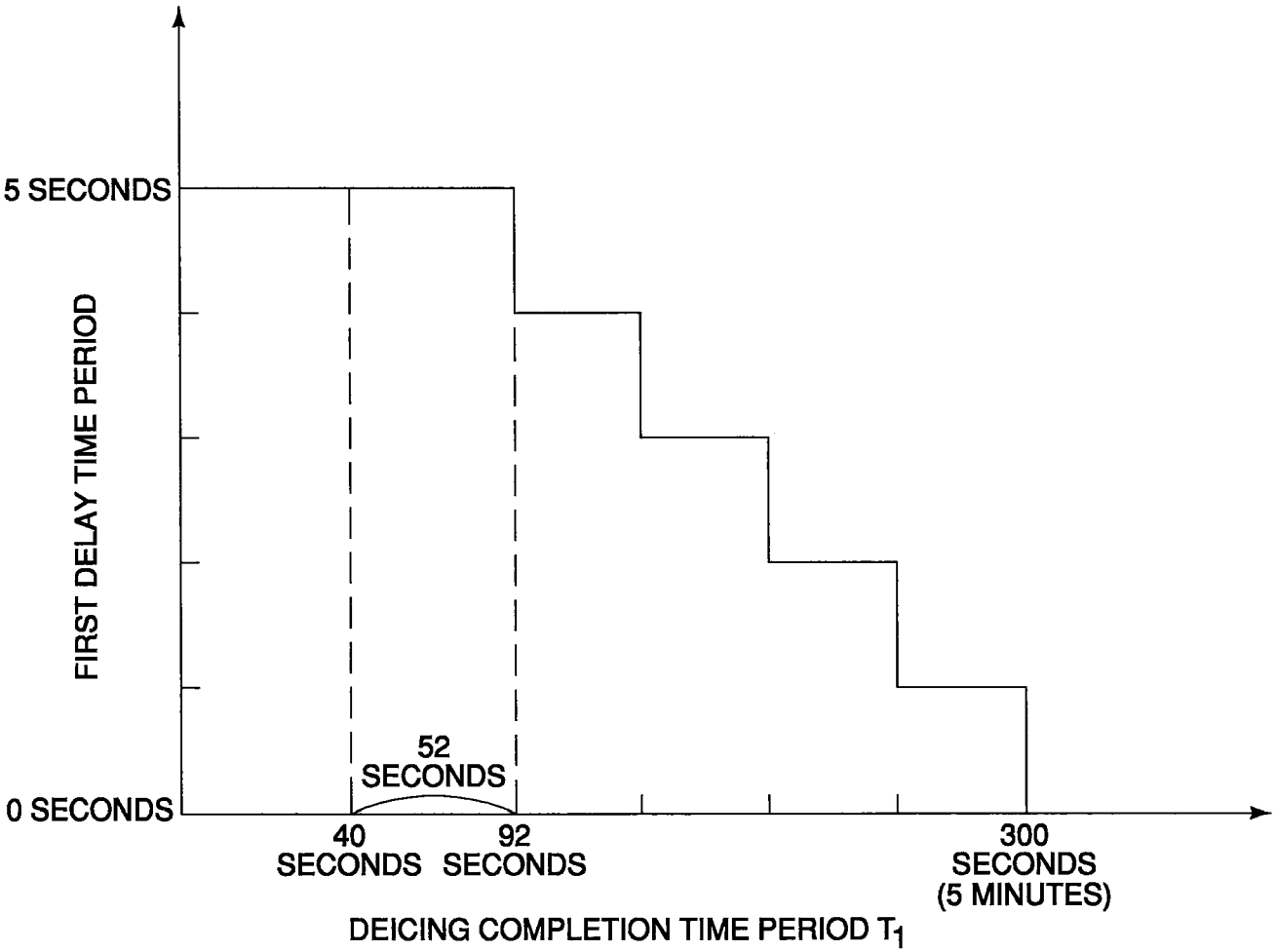
FIG. 10 is a graph showing a first delay time period relative to a deicing completion time period.

Here, in Embodiment 3, the method of water feeding in the high temperature mode is designed to sustain water feeding until the first delay time period is passed after the water level of ice making water in the ice making water tank 18 reaches the upper water level during water feeding. Then, in Embodiment 3, the first delay time period is not always set to be a constant time period (for example, three seconds) as in Embodiment 1, but the first delay time period is designed to be modified in accordance with the deicing completion time period $T_1$. That is, the control means 46 has a delay time calculation unit 50, and the delay time calculation unit 50 is designed to calculate the first delay time period based on the deicing completion time period $T_1$ of deicing operation (refer to FIG. 12). Specifically, as shown in FIG. 10, the first delay time period is set to be five seconds when the deicing completion time period $T_1$ is 40 seconds or less, and the first delay time period is reduced stepwise by one second per 52 seconds of the deicing completion time period $T_1$ between 40 seconds and 5 minutes (300 seconds). For example, the first delay time period becomes four seconds when the deicing completion time period $T_1$ is 92 seconds, and the first delay time period becomes three seconds when the deicing completion time period $T_1$ is 144 seconds. As thus described, by modifying the first delay time period in accordance with the deicing completion time period $T_1$, it becomes possible to determine an optimum feeding amount of water at high temperature depending on the temperature of makeup water.

Figure 11:
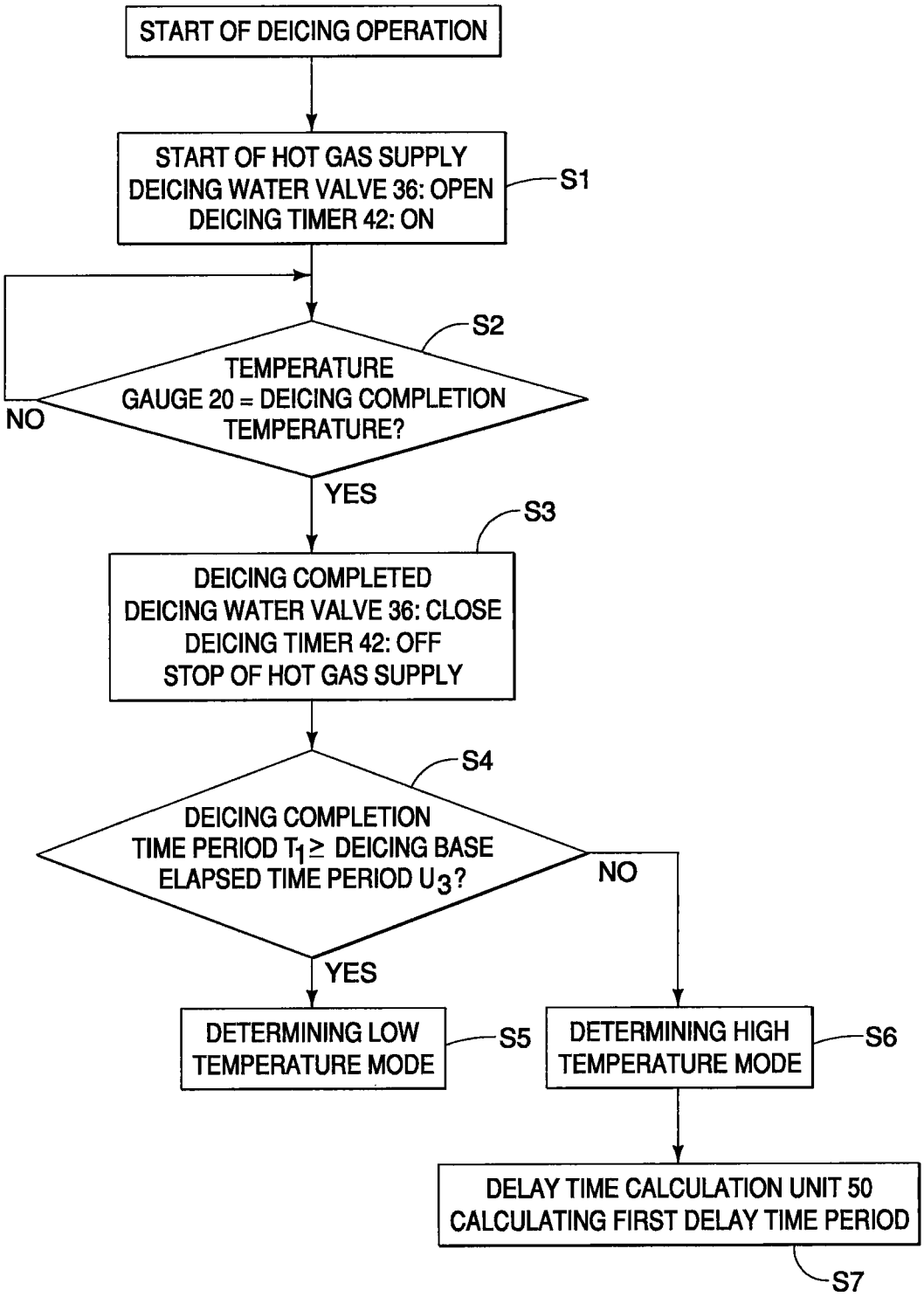
FIG. 11 is a flowchart showing a procedure of determining a water feeding mode in deicing operation of Embodiment 3.

Next, a description is given to action of the automatic ice making machine 48 according to Embodiment 3 in a case of determining the water feeding mode in deicing operation. As shown in FIG. 11, when deicing operation is started, the control means 46 allows a hot gas to be supplied to the evaporation tube 14 and also opens the deicing water valve 36 to supply deicing water to the ice making unit 16 from the external water supply source via the deicing water spray 34 (Step S1). In addition, the control means 46 activates the deicing timer 42 concurrently with starting deicing operation to keep time of the deicing completion time period $T_1$. Then, when the temperature measured by the temperature gauge 20 reaches the deicing completion temperature (Yes in Step S2), the control means 46 finishes the deicing operation and also stops the deicing timer 42 to measure the deicing completion time period $T_1$ (Step S3).

Next, the control means 46 determines whether or not the deicing completion time period $T_1$ is equal to or greater than the deicing base elapsed time period $U_3$ (Step S4), and when the deicing completion time period $T_1$ is equal to or greater than the deicing base elapsed time period $U_3$ (Yes in Step S4), the control means 46 determines the water feeding mode to be in the low temperature mode (Step S5). In contrast, in a case where the deicing completion time period $T_1$ is shorter than the deicing base elapsed time period $U_3$ (No in Step S4), the control means 46 determines the water feeding mode to be in the high temperature mode (Step S6). Next, in a case where the high temperature mode is determined, the delay time calculation unit 50 determines the first delay time period from the deicing completion time period $T_1$ (Step S7). For example, in a case where the deicing completion time period $T_1$ is 92 seconds, the delay time calculation unit 50 determines the first delay time period to be four seconds.

As mentioned above, in deicing operation, the water feeding mode and the first delay time period are determined. Then, when shifted to ice making operation, in a case of the high temperature mode, the timing of stopping water feeding is delayed by the first delay time period. That is, in the high temperature mode, water feeding is started when the water level of ice making water in the ice making water tank 18 reaches the lower water level, and at the point in time where the water level of the ice making water reaches the upper water level, the delay timer 44 keeps time of the first delay time period. Then, at the point in time where the delay timer 44 keeps time of the first delay time period (in the previous example, four seconds) calculated in the delay time calculation unit 50, the control means 46 stops water feeding.

Figure 12:
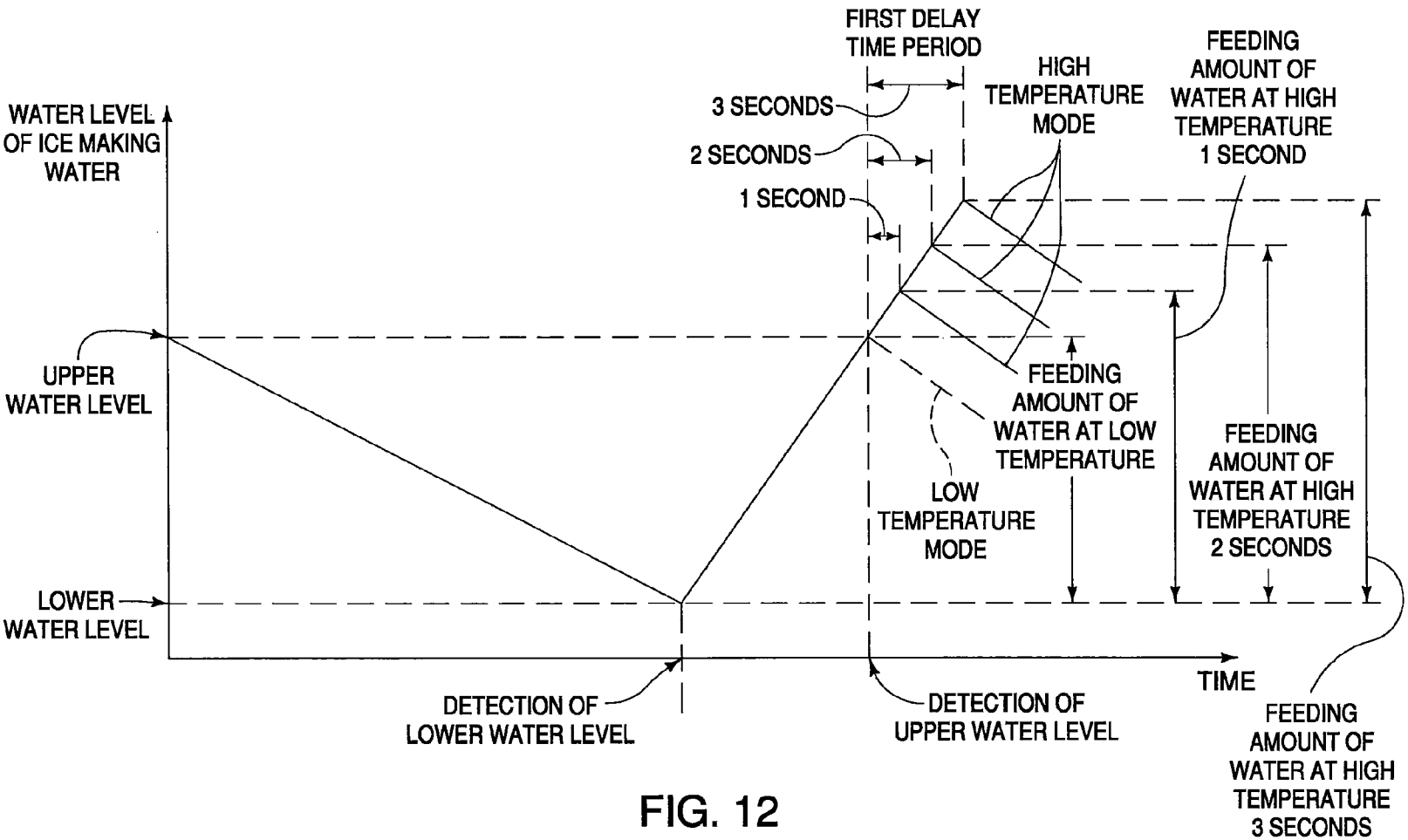
FIG. 12 is a graph showing variation in a water level of ice making water in an ice making water tank in Embodiment 3.

As thus described, in the automatic ice making machine 48 of Embodiment 3, by modifying the first delay time period in accordance with the deicing completion time period $T_1$, as shown in FIG. 12, it is possible to feed water in an appropriate feeding amount of water at high temperature corresponding to the temperature of makeup water (deicing water). Accordingly, more flexible water feeding can be carried out compared to a case of water feeding always in a constant feeding amount of water at high temperature, and thus a decrease in ice making capacity due to lack in water feeding can be prevented more securely. In addition, by modifying the first delay time period in accordance with the deicing completion time period $T_1$, water can be fed in an optimum amount of feeding water in the high temperature mode, and thus waste of makeup water can be prevented and the running cost can be inexpensive. In the automatic ice making machine 48 of Embodiment 3, in the same manner as Embodiment 1 or the like, in the low temperature mode, makeup water is supplied during water feeding in the feeding amount of water at low temperature of from the lower water level to the upper water level of the ice making water tank 18. Accordingly, in a case of makeup water at low temperature, excessive water feeding is prevented and it is possible to suppress occurrence of deicing abnormity and deformation, damage, or the like in the ice making unit 16. In Embodiment 3, the first delay time period is modified stepwise by one second in accordance with the deicing completion time period $T_1$, while the first delay time period may also be modified proportionally (linearly) in accordance with the deicing completion time period $T_1$. In addition, in Embodiment 3, the first delay time period is modified in accordance with the deicing completion time period $T_1$, while the second delay time period may also be modified in accordance with the deicing completion time period $T_1$.

Embodiment 4

Next, a description is given below to an automatic ice making machine according to Embodiment 4. Also in Embodiment 4, descriptions are given only to configurations different from Embodiment 1 and descriptions for configurations same as Embodiment 1 are omitted by assigning same reference numerals.

Figure 13:
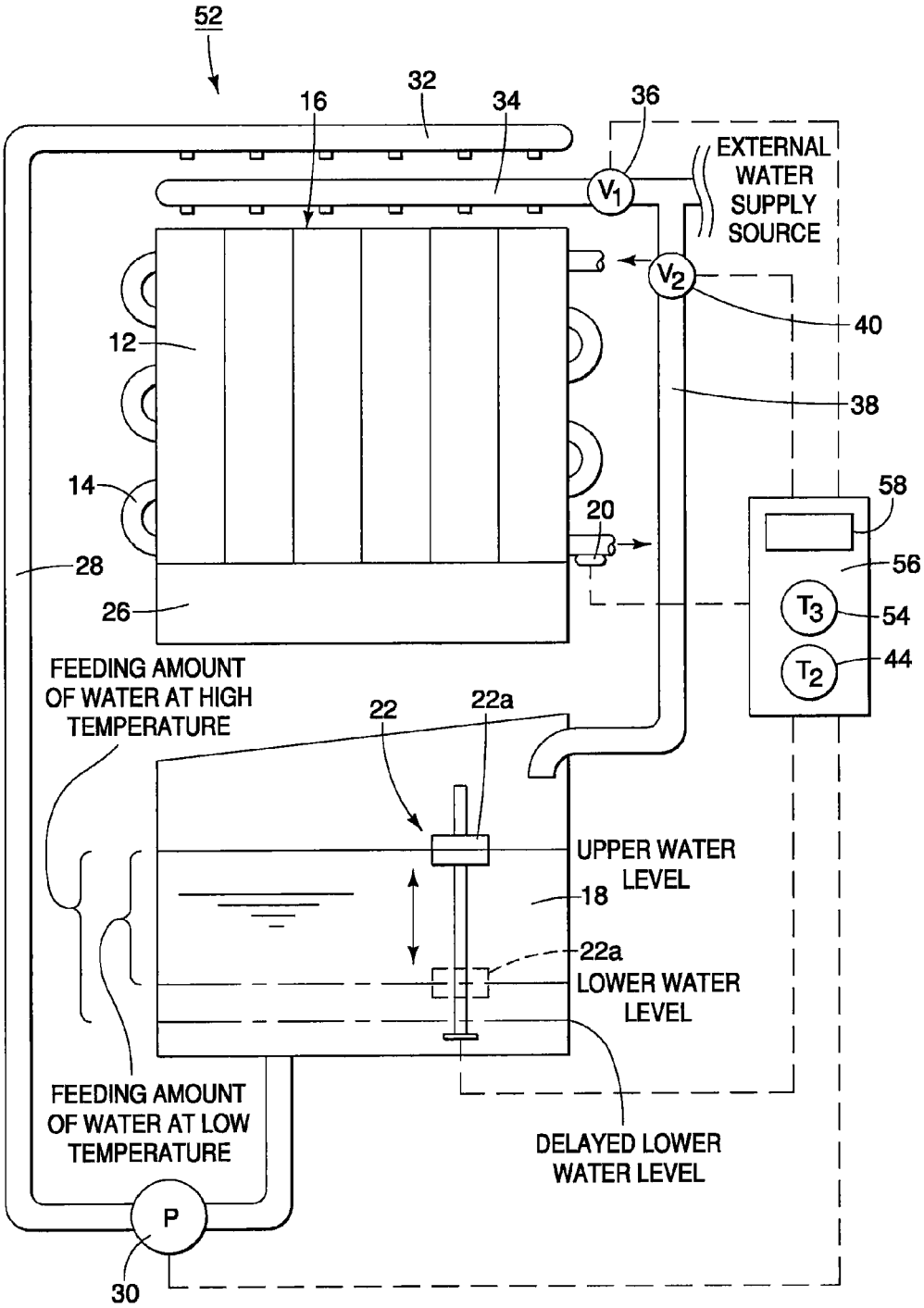
FIG. 13 is a schematic diagram illustrating the entire configuration of an automatic ice making machine according to Embodiment 4.

FIG. 13 is a schematic diagram illustrating an automatic ice making machine 52 according to Embodiment 4. A control means 56 according to Embodiment 4 is designed to determine the water feeding mode during ice making operation. That is, the control means 56 has, instead of the deicing timer 42 to keep time of the deicing completion time period $T_1$, a built-in ice making timer 54 to keep time of a reference temperature reaching time period $T_2$. In addition, in the control means 56 of Embodiment 4, an ice making base elapsed time period $U_4$ is preset, and the control means 56 is designed to compare the reference temperature reaching time period $T_2$ and the ice making base elapsed time period $U_4$ upon determining the water feeding mode. Here, the reference temperature reaching time period $T_2$ refers to time required for the temperature on the exit side of the ice making unit 16 in the evaporation tube 14 (temperature measured by the temperature gauge 20) to reach a preset reference temperature from the start of ice making operation. This reference temperature refers to a temperature on the exit side of the ice making unit 16 at the time when ice making operation progresses to some extent to cool ice making water and the ice making unit 16 and thus ice blocks are started to be produced in the ice making unit 16.

That is, ice making water in the ice making water tank 18 at the time when ice making operation is started is water supplied as deicing water from the external water supply source during deicing operation, so that when the ice making water is high in temperature, it takes time to cool the ice making water. Accordingly, when ice making water is high in temperature, it takes time to decrease the temperature of a refrigerant on the exit side of the ice making unit 16, and the reference temperature reaching time period $T_2$ becomes longer in which the temperature measured by the temperature gauge 20 reaches the reference temperature. In contrast, when ice making water in the ice making water tank 18 is low in temperature at the time of starting ice making operation, it takes shorter time to cool the ice making water and the temperature of the refrigerant on the exit side of the ice making unit 16 is also decreased earlier, and thus the reference temperature reaching time period $T_2$ becomes shorter.

In addition, the ice making base elapsed time period $U_4$ refers to a time period required for the temperature gauge 20 to reach the reference temperature in a case of starting ice making operation in a state where ice making water at a predetermined base temperature is stored in the ice making water tank 18. For example, when the base temperature of ice making water is set at 10° C. and the reference temperature is set at 2° C., the ice making base elapsed time period $U_4$ is three minutes. Then, when the actual temperature of ice making water is higher than the base temperature, the reference temperature reaching time period $T_2$ becomes longer than the ice making base elapsed time period $U_4$, so that the control means 56 determines that the temperature of makeup water from the external water supply source identical to that of the ice making water (deicing water) is also high in temperature, and thus it determines the water feeding mode to be in the high temperature mode. In contrast, when the temperature of ice making water is lower than the base temperature, the reference temperature reaching time period $T_2$ becomes equal to or less than the ice making base elapsed time period $U_4$, so that the control means 56 determines that the temperature of makeup water from the external water supply source identical to that of ice making water (deicing water) is also low in temperature, and thus it determines the water feeding mode to be in the low temperature mode. The base temperature and the reference temperature of ice making water are set for each model of the automatic ice making machine 52, and the ice making base elapsed time period U4 is determined based on the base temperature and the reference temperature.

Figure 14:
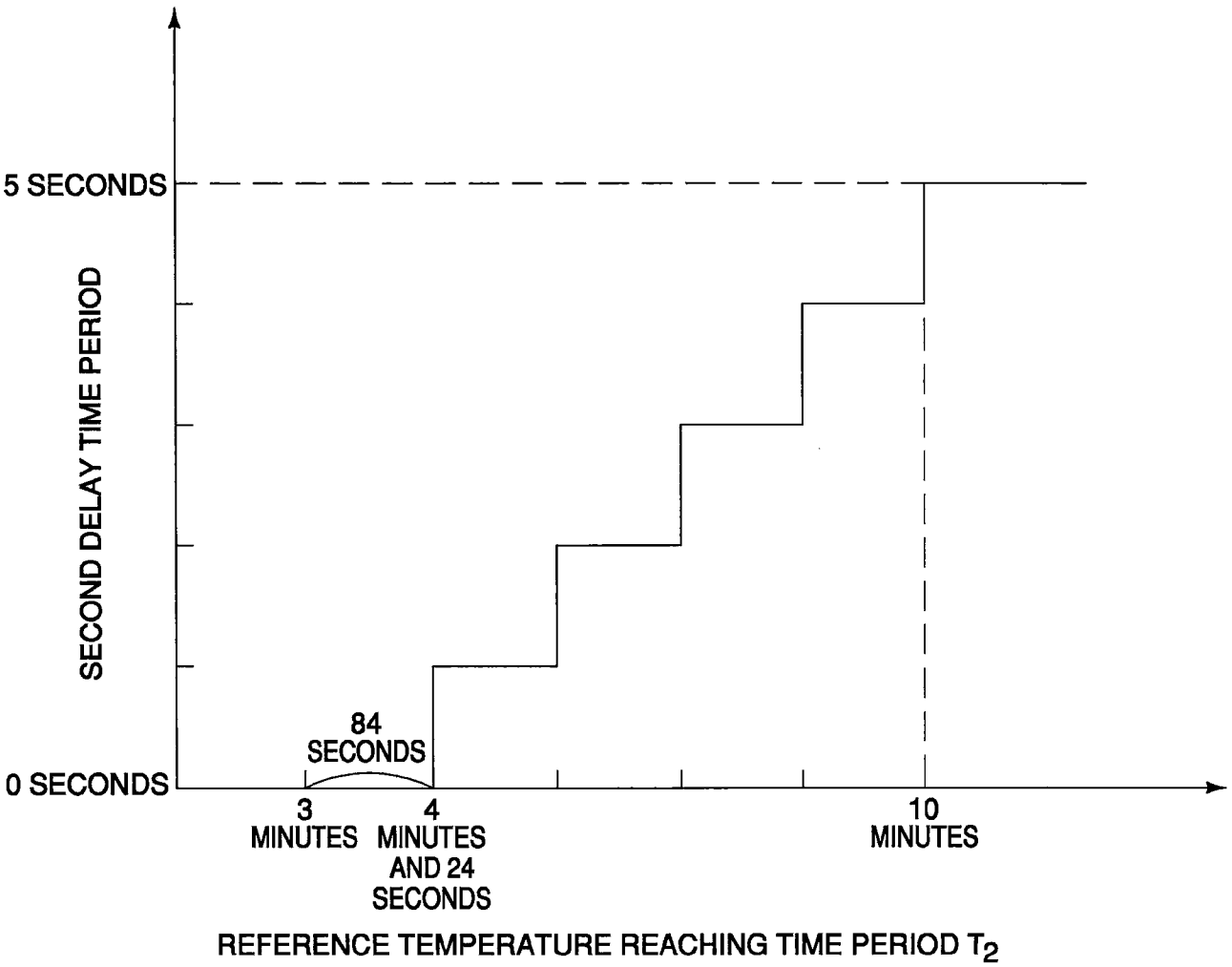
FIG. 14 is a graph showing a second delay time period relative to a reference temperature reaching time period.
Figure 16:
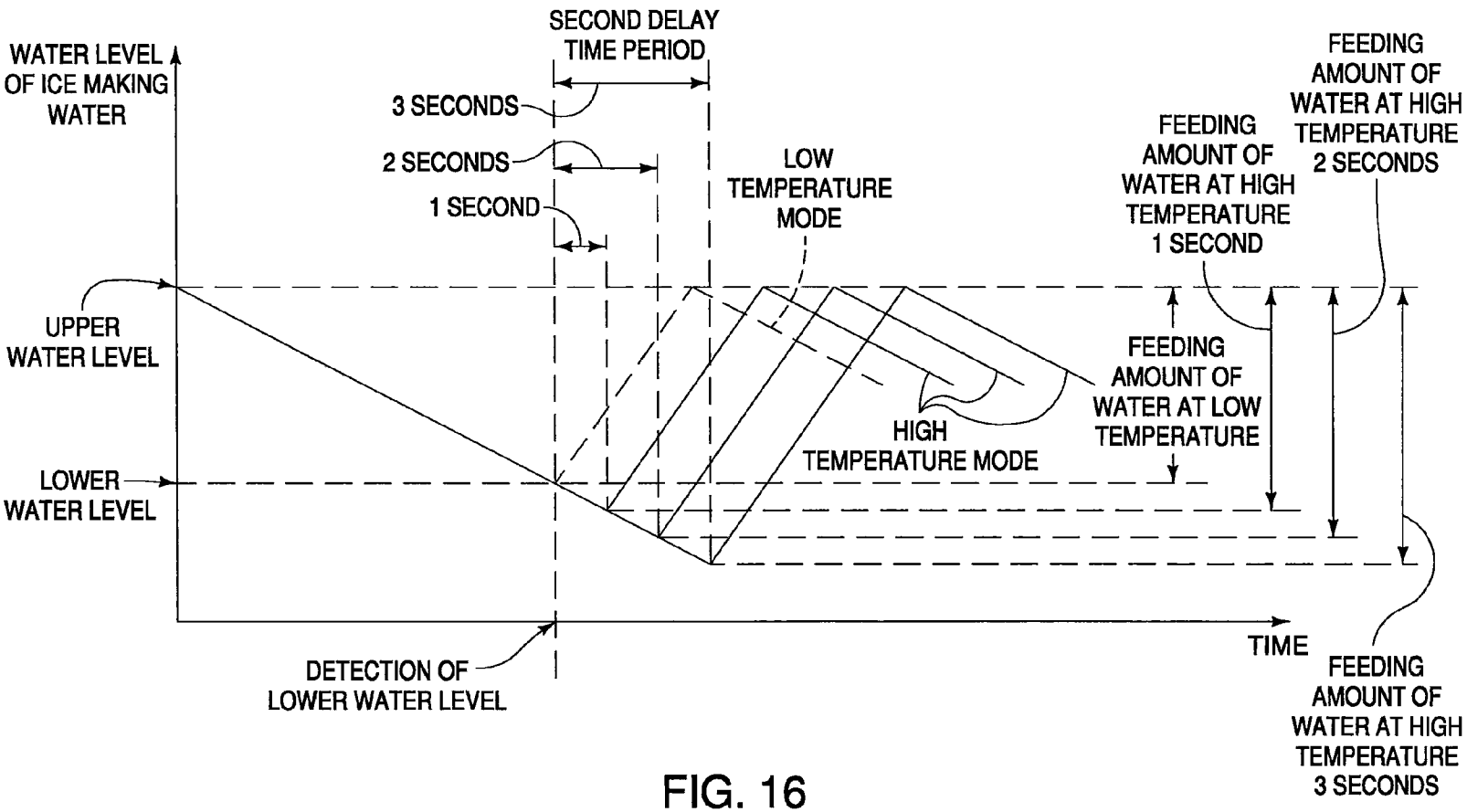
FIG. 16 is a graph showing variation in a water level of ice making water in an ice making water tank in Embodiment 4.

In addition, in Embodiment 4, the method of water feeding in the high temperature mode is designed to start water feeding after the second delay time period has passed since the water level of ice making water in the ice making water tank 18 reaches the lower water level. Here, in the modification of Embodiment 1 described above, the second delay time period is always a constant time period (for example, three seconds), while in Embodiment 4, as shown in FIG. 16, the second delay time period is designed to be modified in accordance with the reference temperature reaching time period $T_2$. That is, the control means 56 has a delay time calculation unit 58 and the delay time calculation unit 58 calculates the second delay time period based on the reference temperature reaching time period $T_2$. For example, as shown in FIG. 14, the second delay time period becomes 0 seconds when the reference temperature reaching time period $T_2$ is equal to or less than three minutes, and the second delay time period is designed to be increased stepwise by one second per 84 seconds of the reference temperature reaching time period $T_2$ between three and ten minutes and to be five seconds for ten minutes or more. Accordingly, the second delay time period becomes one second when the reference temperature reaching time period $T_2$ is four minutes and 24 seconds, and the second delay time period becomes two seconds when the reference temperature reaching time period $T_2$ is five minutes and 48 seconds. As thus described, by modifying the second delay time period in accordance with the reference temperature reaching time period $T_2$, it becomes possible to feed water in an optimum feeding amount of water at high temperature depending on the temperature of ice making water (makeup water).

Figure 15:
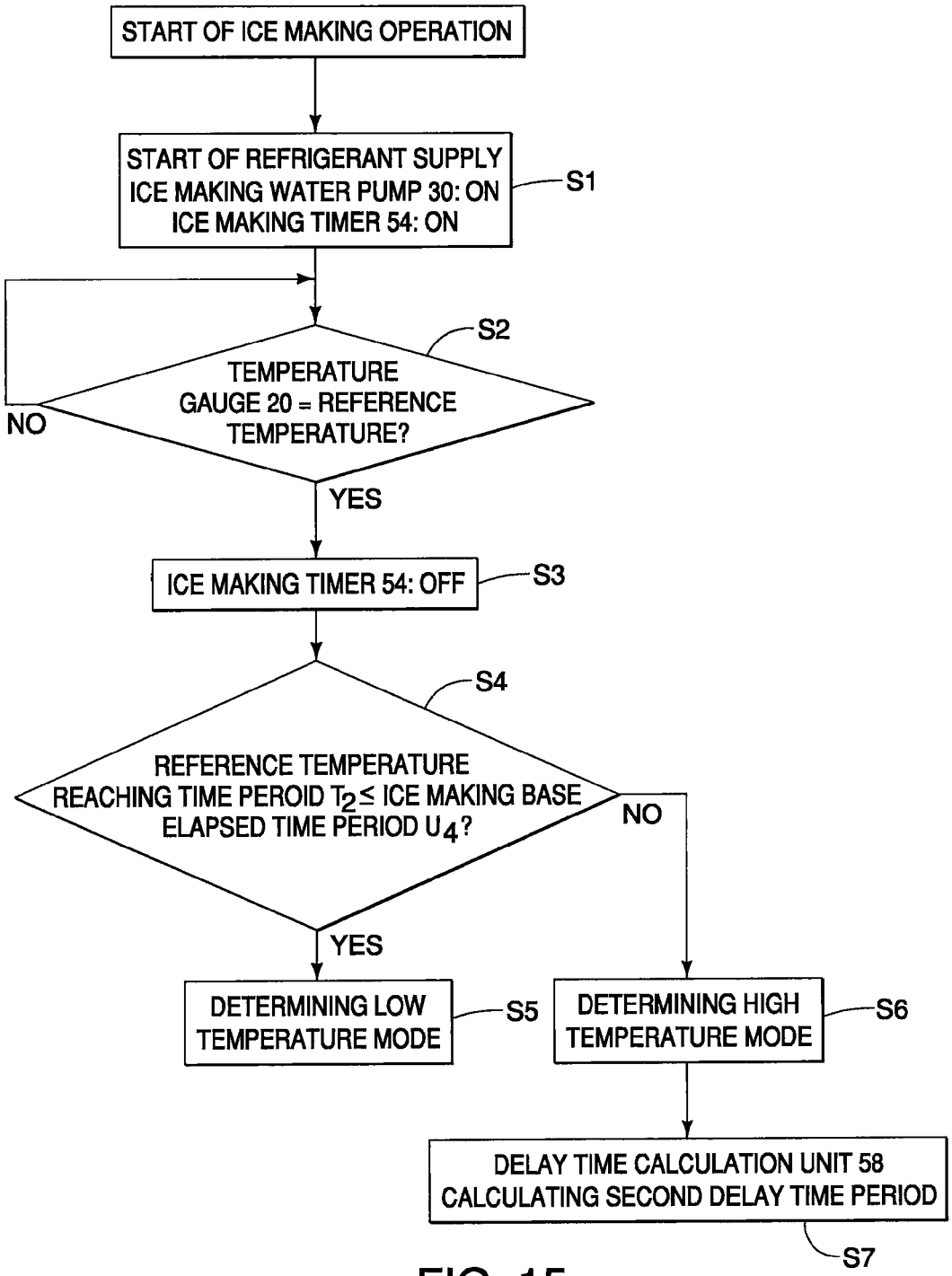
FIG. 15 is a flowchart showing a procedure of determining a water feeding mode in ice making operation of Embodiment 4.

Next, a description is given to action of the automatic ice making machine 52 according to Embodiment 4 in a case of determining the water feeding mode in ice making operation. As shown in FIG. 15, when ice making operation is started, the control means 56 allows a refrigerant to be supplied to the evaporation tube 14, and also activates the ice making water pump 30 to circulatively supply ice making water to the ice making unit 16 (Step S1). In addition, it activates the ice making timer 54 to keep time of the reference temperature reaching time period $T_2$. Here, ice making water supplied to the ice making water tank 18 in deicing operation is high in temperature in an initial stage of ice making operation, and thus is cooled while being circulatively supplied to the ice making unit 16. Accordingly, the temperature on the exit side of the ice making unit 16 in the evaporation tube 14 (temperature measured by the temperature gauge 20) becomes high depending on the temperature of ice making water at the time when ice making operation is started:

When the temperature of ice making water is gradually decreased as ice making operation progresses, the temperature measured by the temperature gauge 20 is also decreased.

Then, when the temperature measured by the temperature gauge 20 reaches the reference temperature (2° C.) (Yes in Step S2), the control means 56 stops the ice making timer 54 to measure the reference temperature reaching time period $T_2$ (Step S3). Then, it compares the reference temperature reaching time period $T_2$ and the ice making base elapsed time period $U_4$ (Step S4), and when the reference temperature reaching time period $T_2$ is equal to or less than the ice making base elapsed time period $U_4$ (Yes in Step S4), the control means 56 determines the water feeding mode to be in the low temperature mode (Step S5). In contrast, in a case where the reference temperature reaching time period $T_2$ is longer than the ice making base elapsed time period $U_4$ (No in Step S4), the control means 56 determines the water feeding mode to be in the high temperature mode (Step S6). Further, in a case where the water feeding mode is determined to be in the high temperature mode, the control means 56 allows the delay time calculation unit 58 to calculate the second delay time period (Step S7). Then, the delay time calculation unit 58 calculates the second delay time period in accordance with the reference temperature reaching time period $T_2$. For example, in a case where the reference temperature reaching time period $T_2$ is five minutes and 24 seconds, the delay time calculation unit 58 sets the second delay time period to be two seconds.

As thus described, in Embodiment 4, the water feeding mode is determined during ice making operation, and the ice making operation is continued without change. Then, in a case of the high temperature mode, when the water level of ice making water in the ice making water tank 18 reaches the lower water level, the float switch 22 detects that and the control means 56 activates the delay timer 44. Then, when the time measured by the delay timer 44 becomes the second delay time period (for example, two seconds) calculated in the delay time calculation unit 58, the control means 56 opens the water feeding valve 40 to start water feeding. At this time, the water level of ice making water becomes the delayed lower water level. Then, when the water level of ice making water reaches the upper water level, the control means 56 closes the water feeding valve 40 to stop water feeding. That is, in the high temperature mode, the timing of starting water feeding is delayed by the second delay time period calculated in the delay time calculation unit 58, so that it is possible to feed water in the feeding amount of water at high temperature of from the delayed lower water level to the upper water level. Moreover, an appropriate value is set for the second delay time period in accordance with the reference temperature reaching time period $T_2$ (temperature of ice making water), so that it is possible to carry out more flexible water feeding compared to a case of water feeding always in a constant feeding amount of water at high temperature (refer to FIG. 16). Accordingly, it is possible to eliminate waste of water feeding in the high temperature mode and thus the running cost becomes inexpensive, and also a decrease in ice making capacity due to lack in water feeding does not occur.

Also in the automatic ice making machine 52 of Embodiment 4, in the low temperature mode, water feeding is designed to be started after the water level of ice making water in the ice making water tank 18 reaches the lower water level and to stop water feeding when the water level of ice making water reaches the upper water level. Accordingly, in a case of ice making water (makeup water) at low temperature, less makeup water compared to the feeding amount of water at high temperature is fed, so that it is possible to prevent occurrence of deicing fault, and a failure or the like in the ice making unit 16 by production of huge ice blocks in the ice making unit 16. In Embodiment 4, the second delay time period is modified stepwise by one second in accordance with the reference temperature reaching time period $T_2$, while the second delay time period may also be modified proportionally (linearly) in accordance with the reference temperature reaching time period $T_2$. Further, in Embodiment 4 the second delay time period is modified, while it is also possible to modify the first delay time period, as in Embodiment 3, in accordance with the reference temperature reaching time period $T_2$. In Embodiment 4, a description is given to a so-called flow-down type automatic ice making machine, while in the present invention to determine the water feeding mode during ice making operation, it is possible to employ a sealing type automatic ice making machine or the like of a closed cell system or an open cell system.

The automatic ice making machine according to the present invention is not limited to Embodiments and the modification mentioned above but the following modifications are possible.

(1) In Embodiments and the modification, the amount of feeding water (feeding amount of water at high temperature and feeding amount of water at low temperature) is controlled based on the water level detection by the float switch during water feeding, while the amount of feeding water may also be controlled by, for example, the water feeding time period. For example, the water feeding valve may also be opened for ten seconds in the feeding amount of water at high temperature, and the water feeding valve may also be opened for eight seconds in the feeding amount of water at low temperature.

(2) In Embodiments and the modification, the completion of deicing operation is detected based on the temperature measured by the temperature gauge, while the completion of deicing operation may also be detected by a sensor or the like that detects the presence/absence of ice on the ice making unit. In addition, in Embodiments and the modification, the completion of ice making operation is also detected from the temperature measured by the temperature gauge, while ice making operation may also be completed when, for example, the float switch detects the lower water level a predetermined number of times. That is, the completion of ice making operation may also be determined from the number of times of water feeding.

(3) In Embodiments and the modification, water is always fed in the feeding amount of water at low temperature of from the lower water level to the upper water level in the low temperature mode, while the feeding amount of water at low temperature may also be modified in accordance with, for example, the temperature of makeup water.

(4) In Embodiments, the external water supply source is illustrated as an external water source, while makeup water and deicing water may also be supplied from, for example, a reservoir tank in which a predetermined amount of water is stored. That is, the external water source may be one in which the temperature of supplied makeup water is varied depending on the installation environment of the automatic ice making machine.

The invention claimed is:

1. An automatic ice making machine comprising:

an ice making unit where ice making water is supplied to an evaporator that is cooled during an ice making operation to produce ice, and where deicing water is supplied from an external water source to the evaporator that is heated during a deicing operation to separate the ice;

an ice making water tank that supplies ice making water to the ice making unit and that collects ice making water that flows down from the ice making unit during the ice making operation;

a water feeding valve that feeds ice making water from the external water source to the ice making water tank;

a deicing timer that measures a deicing completion time period from a start of the deicing operation until separation of ice on the ice making unit; and a control circuit that compares the deicing completion time period with a deicing base elapsed time period that is previously stored in the control circuit, wherein when the deicing completion time period is equal to or longer than the deicing base elapsed time period, the control circuit determines that a temperature of the deicing water is lower than a predetermined base temperature, and controls the water feeding valve so that a certain amount of ice making water required at a low temperature is supplied from the external water source to the ice making water tank, when the deicing completion time period is shorter than the deicing base elapsed time period, the control circuit determines that the temperature of the deicing water is higher than the predetermined base temperature, and controls the water feeding valve so that an amount of ice making water greater than the certain amount of ice making water required at the low temperature is supplied from the external water source to the ice making water tank, the ice making water tank has a float switch that detects a lower water level of ice making water and an upper water level of ice making water, the control circuit has a delay timer that measures a first delay time period, when the temperature of the deicing water is lower than the predetermined base temperature, the control circuit controls the water feeding valve to start supply of ice making water to the ice making water tank when the float switch detects the lower water level and to stop supply of ice making water to the ice making water tank when the float switch detects the upper water level, and when the temperature of the deicing water is higher than the predetermined base temperature, the control circuit controls the water feeding valve to start supply of ice making water to the ice making water tank when the float switch detects the lower water level and to stop supply of ice making water to the ice making water tank when the first delay time period measured by the delay timer has elapsed counting from a time that the float switch detects the upper water level.

2. An automatic ice making machine comprising:

an ice making unit where ice making water is supplied to an evaporator that is cooled during an ice making operation to produce ice, and where deicing water is supplied from an external water source to the evaporator that is heated during a deicing operation to separate the ice;

an ice making water tank that supplies ice making water to the ice making unit and that collects ice making water that flows down from the ice making unit during the ice making operation;

a water feeding valve that feeds ice making water from the external water source to the ice making water tank;

a deicing timer that measures a deicing completion time period from a start of the deicing operation until separation of ice on the ice making unit; and a control circuit that compares the deicing completion time period with a deicing base elapsed time period that is previously stored in the control circuit, wherein when the deicing completion time period is equal to or longer than the deicing base elapsed time period, the control circuit determines that a temperature of the deicing water is lower than a predetermined base temperature, and controls the water feeding valve so that a certain amount of ice making water required at a low temperature is supplied from the external water source to the ice making water tank, when the deicing completion time period is shorter than the deicing base elapsed time period, the control circuit determines that the temperature of the deicing water is higher than the predetermined base temperature, and controls the water feeding valve so that an amount of ice making water greater than the certain amount of ice making water required at the low temperature is supplied from the external water source to the ice making water tank, the ice making water tank has a float switch that detects a lower water level of ice making water and an upper water level of ice making water, the control circuit has a delay timer that measures a second delay time period, when the temperature of the deicing water is lower than the predetermined base temperature, the control circuit controls the water feeding valve to start supply of ice making water to the ice making water tank when the float switch detects the lower water level and to stop supply of ice making water to the ice making water tank when the float switch detects the upper water level, and when the temperature of the deicing water is higher than the predetermined base temperature, the control circuit controls the water feeding valve to start supply of ice making water to the ice making water tank when the second delay time period measured by the delay timer has elapsed counting from a time that the float switch detects the lower water level and to stop supply of ice making water to the ice making water tank when the float switch detects the upper water level.

3. The automatic ice making machine according to claim 1 or 2, wherein when a predetermined temperature of the deicing water is set as a base temperature, a longest time period of deicing water supply that is required from a start of deicing water supply at the base temperature until the separation of ice produced on the ice making unit is established as the deicing base elapsed time period.

* * * * *